US011028332B2

(12) United States Patent
Koseoglu

(10) Patent No.: US 11,028,332 B2
(45) Date of Patent: Jun. 8, 2021

(54) INTEGRATED SELECTIVE HYDROCRACKING AND FLUID CATALYTIC CRACKING PROCESS

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/033,613

(22) Filed: Jul. 12, 2018

(65) Prior Publication Data

US 2019/0040328 A1 Feb. 7, 2019

Related U.S. Application Data

(63) Continuation of application No. 13/558,118, filed on Jul. 25, 2012, now abandoned.
(Continued)

(51) Int. Cl.
*C10G 69/00* (2006.01)
*C10G 69/02* (2006.01)

(52) U.S. Cl.
CPC ..... *C10G 69/02* (2013.01); *C10G 2300/1096* (2013.01); *C10G 2300/202* (2013.01); *C10G 2300/44* (2013.01)

(58) Field of Classification Search
CPC ..... C10G 69/02; C10G 2300/1096; C10G 2300/202; C10G 2300/44
See application file for complete search history.

(56) References Cited

U.S. PATENT DOCUMENTS 2,374,102 A 4/1945 Jahn et al.
2,754,342 A 7/1956 Shelton
(Continued)

FOREIGN PATENT DOCUMENTS

EP 417980 A1 3/1991
JP 60031594 A 2/1985
(Continued)

OTHER PUBLICATIONS

Yuandong Liu et al., "Recent Advanced in Heavy Oil Hydroprocessing Technologies," Recent Patents on Chemical Engineering, 2009, 2, pp. 22-36, Benthan Science Publishers Ltd.
(Continued)

*Primary Examiner* — Prem C Singh
*Assistant Examiner* — Brandi M Doyle
(74) *Attorney, Agent, or Firm* — Abelman, Frayne & Schwab

(57) ABSTRACT

An integrated process and system for conversion of a heavy crude oil to produce transportation fuels is provided. The process includes separating the hydrocarbon feed into an aromatic-lean fraction and an aromatic-rich fraction. The aromatic-rich fraction is hydrocracked under relatively high pressure to convert at least a portion of refractory aromatic organosulfur and organonitrogen compounds and to produce a hydrocracked product stream. Unconverted bottoms effluent is recycled to the aromatic separation step. The aromatic-lean fraction is cracked in a fluidized catalytic cracking reaction zone to produce a cracked product stream, a light cycle oil stream and a heavy cycle oil stream. In certain embodiments the aromatic-lean fraction can be hydrotreated prior to fluidized catalytic cracking.

36 Claims, 9 Drawing Sheets

Related U.S. Application Data

(60) Provisional application No. 61/513,083, filed on Jul. 29, 2011.

(56) References Cited

U.S. PATENT DOCUMENTS

| | | | | |
|---|---|---|---|---|
| 3,001,932 | A * | 9/1961 | Pietsch | C10G 61/04 208/211 |
| 3,023,158 | A * | 2/1962 | Watkins | C10L 1/06 208/89 |
| 3,044,950 | A | 7/1962 | Swartz | |
| 3,065,167 | A * | 11/1962 | Zuiderweg | C10G 21/00 208/311 |
| 3,193,488 | A * | 7/1965 | Carr | C10G 21/00 208/68 |
| 3,714,022 | A | 1/1973 | Stein | |
| 3,758,628 | A | 9/1973 | Strickland et al. | |
| 3,806,445 | A | 4/1974 | Henry et al. | |
| 4,359,596 | A | 11/1982 | Howard et al. | |
| 4,388,176 | A | 6/1983 | Pratt et al. | |
| 4,426,276 | A | 1/1984 | Dean et al. | |
| 4,592,832 | A | 6/1986 | Bristow et al. | |
| 4,713,167 | A | 12/1987 | Reno et al. | |
| 4,853,104 | A | 8/1989 | Degnan et al. | |
| 4,909,927 | A | 3/1990 | Bell | |
| 4,950,384 | A | 8/1990 | Groeneveld et al. | |
| 5,021,143 | A | 6/1991 | Franckowiak et al. | |
| 5,026,472 | A | 6/1991 | Hoehn et al. | |
| 5,041,206 | A | 8/1991 | Sequeira | |
| 5,110,445 | A | 5/1992 | Chen et al. | |
| 5,135,640 | A | 8/1992 | Vizner | |
| 5,318,692 | A | 6/1994 | Eberly et al. | |
| 5,611,912 | A | 3/1997 | Han et al. | |
| 5,643,442 | A | 7/1997 | Sweet et al. | |
| 5,770,044 | A | 6/1998 | Ellis et al. | |
| 5,880,325 | A | 3/1999 | Alward et al. | |
| 5,995,440 | A | 3/1999 | Hoehn et al. | |
| 5,904,835 | A | 5/1999 | Thakkar | |
| 5,935,416 | A | 8/1999 | Cody et al. | |
| 6,113,775 | A | 9/2000 | Christolini et al. | |
| 6,171,478 | B1 | 1/2001 | Cabrera et al. | |
| 6,217,746 | B1 | 4/2001 | Thakkar et al. | |
| 6,312,586 | B1 | 11/2001 | Kalnes et al. | |
| 6,620,313 | B1 | 9/2003 | Demmin et al. | |
| 6,676,829 | B1 | 1/2004 | Angevine et al. | |
| 6,843,906 | B1 | 1/2005 | Eng | |
| 6,866,772 | B2 | 3/2005 | Selai et al. | |
| 6,951,605 | B2 | 10/2005 | Cody et al. | |
| 6,974,535 | B2 | 12/2005 | Cody et al. | |
| 7,074,321 | B1 | 7/2006 | Kalnes | |
| 7,597,795 | B2 | 10/2009 | Schleicher et al. | |
| 7,857,964 | B2 | 12/2010 | Mashiko et al. | |
| 7,883,618 | B2 | 2/2011 | Claud et al. | |
| 2001/0013484 | A1* | 8/2001 | Zeuthen | C10G 65/08 208/89 |
| 2001/0042699 | A1 | 11/2001 | Cash et al. | |
| 2002/0153281 | A1 | 10/2002 | Cody et al. | |
| 2002/0153283 | A1 | 10/2002 | Chester et al. | |
| 2002/0195373 | A1* | 12/2002 | Ino | C10G 69/04 208/113 |
| 2004/0004025 | A1 | 1/2004 | Xu et al. | |
| 2004/0168955 | A1 | 9/2004 | Boucher et al. | |
| 2006/0118463 | A1 | 6/2006 | Coylar et al. | |
| 2006/0249429 | A1* | 11/2006 | Iki | B01J 21/063 208/209 |

FOREIGN PATENT DOCUMENTS

| | | | |
|---|---|---|---|
| WO | 0040677 | A1 | 7/2000 |
| WO | 2005056728 | A2 | 6/2005 |
| WO | 2005056728 | A3 | 6/2005 |
| WO | 2007005298 | A2 | 1/2007 |
| WO | 2007039047 | A1 | 4/2007 |
| WO | 2008057546 | A2 | 5/2008 |

OTHER PUBLICATIONS

Mohan S. Rana et al., "A Review of Recent Advances on Process Technologies for Upgrading of Heavy Oils and Residua," Fuel , vol. 86, 7 Sep. 2006, pp. 1216-1231.

PCT Application No. PCT/US2012/048165, International Search Report and Written Opinion established by the European Patent Office, dated Dec. 12, 2012, 10 pages.

Mehra and Al-Abdulal, Hydrogen Purification in Hydroprocessing, Mar. 2005, pp. 1-13.

* cited by examiner

INTEGRATED SELECTIVE HYDROCRACKING AND FLUID CATALYTIC CRACKING PROCESS

RELATED APPLICATIONS

This application is a continuation application of U.S. patent application Ser. No. 13/558,118 filed Jul. 25, 2012, which claims the benefit of U.S. Provisional Patent Application No. 61/513,083 filed Jul. 29, 2011, the disclosures of which are hereby incorporated by reference in its entirety.

BACKGROUND OF THE INVENTION

Field of the Invention

The present invention relates to integrated processes and systems for conversion of heavy crude oil to produce ultra low sulfur transportation fuels.

Description of Related Art

Compositions of natural petroleum or crude oils are significantly varied based on numerous factors, mainly the geographic source, and even within a particular region, the composition can vary. Common to virtually all sources of crude is the existence of heteroatoms such as sulfur, nitrogen, nickel, vanadium and others in quantities that impact the refinery processing of the crude oils fractions. Light crude oils or condensates contain sulfur as low as 0.01 weight % (W %), in contrast, heavy crude oils contains as high as 5-6 W %. Similarly, the nitrogen content of crude oils is in the range of 0.001-1.6 W %. These impurities must be removed during the refining to meet the environmental regulations for the final products (e.g., gasoline, diesel, fuel oil) or for the intermediate refining streams that need to be processed for further upgrading such as reforming isomerization.

Crude oils are refined to produce transportation fuels and petrochemical feedstocks. Typically fuels for transportation are produced by processing and blending of distilled fractions from the crude to meet the particular end use specifications. After initial atmospheric and/or vacuum distillation, fractions are converted into products by various catalytic and non-catalytic processes. Catalytic processes are generally categorized based on the presence or absence of reaction hydrogen. Processes including hydrogen, often broadly referred to as hydroprocessing, include, for example, hydrotreating primarily for desulfurization and denitrification, and hydrocracking for conversion of heavier compounds into lighter compounds more suitable for certain product specifications. Processes that do not include additional hydrogen include fluidized catalytic cracking.

The second mode is the catalytic conversion of hydrocarbon feedstock with added hydrogen at reaction conversion temperatures less than about 540° C. with the reaction zone comprising a fixed bed of catalyst. Although the fixed bed hydrocracking process, as the second mode is commonly known, has achieved commercial acceptance by petroleum refiners, this process has several disadvantages as hereinafter described. In order to attempt to achieve long runs and high on-stream reliability, fixed bed hydrocrackers require a high inventory of catalyst and a relatively high pressure reaction zone which is generally operated at 150 kg/cm$^2$ or greater to achieve catalyst stability. Two phase flow of reactants over a fixed bed of catalyst often creates maldistribution within the reaction zone with the concomitant inefficient utilization of catalyst and incomplete conversion of the reactants. Momentary misoperation or electrical power failure can cause severe catalyst coking which may require the process to be shut down for catalyst regeneration or replacement.

Because most crude oil available today is high in sulfur, the distilled fractions must be desulfurized to yield products which meet performance specifications and/or environmental standards.

The discharge into the atmosphere of sulfur compounds during processing and end-use of the petroleum products derived from sulfur-containing sour crude oil poses health and environmental problems. Stringent reduced-sulfur specifications applicable to transportation and other fuel products have impacted the refining industry, and it is necessary for refiners to make capital investments to greatly reduce the sulfur content in gas oils to 10 parts per million by weight (ppmw) or less. In the industrialized nations such as the United States, Japan and the countries of the European Union, refineries have already been required to produce environmentally clean transportation fuels. For instance, in 2007 the United States Environmental Protection Agency required the sulfur content of highway diesel fuel to be reduced 97%, from 500 ppmw (low sulfur diesel) to 15 ppmw (ultra-low sulfur diesel). The European Union has enacted even more stringent standards, requiring diesel and gasoline fuels sold in 2009 to contain less than 10 ppmw of sulfur. Other countries are following in the footsteps of the United States and the European Union and are moving forward with regulations that will require refineries to produce transportation fuels with ultra-low sulfur levels.

Sulfur-containing compounds that are typically present in hydrocarbon fuels include aliphatic and aromatic molecules. Aliphatic sulfur-containing compounds include sulfides, disulfides and mercaptans. Aromatic molecules include thiophene, benzothiophene and its long chain alkylated derivatives, and dibenzothiophene and its alkyl derivatives such as 4,6-dimethyl-dibenzothiophene. Certain highly branched aromatic molecules can sterically hinder the sulfur atom removal and are moderately more difficult to desulfurize (refractory) using mild hydrodesulfurization methods.

Among the sulfur-containing aromatic compounds, thiophenes and benzothiophenes are relatively easy to remove using conventional hydrodesulfurization under relatively mild conditions. The addition of alkyl groups to the ring compounds increases the difficulty of hydrodesulfurization (i.e., requires higher temperature, catalyst requirement, etc.), and often other types of sulfur removal techniques are deployed.

Dibenzothiophenes resulting from addition of another ring to the benzothiophene family are even more difficult to desulfurize, and the difficulty varies greatly according to their alkyl substitution, with di-beta substitution being the most difficult to desulfurize, thus justifying their "refractory" appellation. These beta substituents hinder exposure of the heteroatom to the active site on the catalyst.

The economical removal of refractory sulfur-containing compounds is therefore exceedingly difficult to achieve, and accordingly removal of sulfur-containing compounds in hydrocarbon fuels to an ultra-low sulfur level is very costly by current hydrotreating techniques. When previous regulations permitted sulfur levels up to 500 ppmw, there was little need or incentive to desulfurize beyond the capabilities of conventional hydrodesulfurization, and hence the refractory sulfur-containing compounds were not targeted. However, in order to meet the more stringent sulfur specifications, these refractory sulfur-containing compounds must be substantially removed from hydrocarbon fuels streams.

Hydrocracking processes are used commercially in a large number of petroleum refineries. They are used to process a variety of feeds boiling in the range of 370° C. to 520° C. in conventional hydrocracking units and boiling at 520° C. and above in the residue hydrocracking units. In general, hydrocracking processes split the molecules of the feed into smaller, i.e., lighter, molecules having higher average volatility and economic value. Additionally, hydrocracking processes typically can serve as a desulfurization and denitrification step.

Mild hydrocracking or single stage once-through hydrocracking operations, typically the simplest of the known hydrocracking configurations, occur at conditions that are more severe than typical hydrotreating processes, and less severe than typical full pressure hydrocracking. This hydrocracking process is more cost effective, but typically results in comparatively lower product yield and higher heteroatom (including sulfur and nitrogen) content. Single or multiple catalysts systems can be used depending upon the feedstock and product specifications. Multiple catalyst systems can be deployed as a stacked-bed configuration or in multiple reactors. Mild hydrocracking operations are generally more cost effective, but typically result in both a lower yield and reduced quality of mid-distillate product as compared to full pressure hydrocracking operations.

In a series-flow hydrocracking process, the entire hydrotreated/hydrocracked product stream from the first reactor, including light gases (e.g., $C_1$-$C_4$, $H_2S$, $NH_3$) and all remaining hydrocarbons, are sent to the second reactor. In two-stage configurations the feedstock is refined by passing it over a hydrotreating catalyst bed in the first reactor for enhanced heteroatom removal. The effluents are passed to a fractionator column to separate the light gases, naphtha and diesel products, e.g., boiling in the temperature range of 36° C. to 370° C. The heavier hydrocarbons are passed to the second reactor for additional cracking.

Catalytic conversion of hydrocarbons without the addition of hydrogen is another type of process for certain fractions. The most widely used processes of this type are commonly referred to as fluidized catalytic cracking (FCC) processes. A feedstock is introduced to the conversion zone typically operating in the range of from about 480° C. to about 550° C. with a circulating catalyst stream, thus the appellation "fluidized." This mode has the advantage of being performed at relatively low pressure, i.e., 50 psig or less. However, certain drawbacks of FCC processes include relatively low hydrogenation and relatively high reaction temperatures that tend to accelerate coke formation on the catalyst and requiring continuous regeneration.

In FCC processes, the feed is catalytically cracked over a fluidized acidic catalyst bed. The main product from such processes is conventionally been gasoline, although other products are also produced in smaller quantities via FCC processes such as liquid petroleum gas and cracked gas oil. Coke deposited on the catalyst is burned off in a regeneration zone at relatively high temperatures and in the presence of air prior to recycling back to the reaction zone.

While individual and discrete hydrocracking and FCC processes are well-developed and suitable for their intended purposes, there nonetheless remains a need for processes for high yield conversion of heavy crude oil fractions into high quality transportation fuels in an economical and efficacious manner.

SUMMARY OF THE INVENTION

In accordance with one or more embodiments, the invention relates to systems and processes that combine hydrocracking, hydrotreating and FCC processes to optimize the conversion of heavy feedstocks crude oil to produce clean hydrocarbon fuels.

In accordance with one or more embodiments, an integrated process for conversion of a heavy crude oil to produce transportation fuels is provided. The process includes:

a. separating the hydrocarbon feed into an aromatic-lean fraction that contains labile organosulfur compounds and an aromatic-rich fraction that contains sterically hindered refractory aromatic organosulfur and organonitrogen compounds;

b. passing the aromatic-rich fraction to a hydrocracking reaction zone operating under relatively high pressure to convert at least a portion of refractory aromatic organosulfur and organonitrogen compounds and to produce a hydrocracked product stream and an unconverted bottoms effluent;

c. recycling at least a portion of the unconverted bottoms effluent to the aromatic separation step; and d. passing the aromatic-lean fraction to a fluid catalytic cracking reaction zone to produce a cracked product stream, a light cycle oil stream and a heavy cycle oil stream.

In accordance with one or more further embodiments, an integrated process for conversion of a heavy crude oil to produce transportation fuels is provided. The process includes:

a. separating the hydrocarbon feed into an aromatic-lean fraction that contains labile organosulfur and organonitrogen compounds and an aromatic-rich fraction that contains sterically hindered refractory aromatic organosulfur compounds;

b. passing the aromatic-rich fraction to a hydrocracking reaction zone operating under relatively high pressure to convert at least a portion of refractory aromatic organosulfur and organonitrogen compounds and to produce a hydrocracked product stream and an unconverted bottoms effluent;

c. recycling at least a portion of the unconverted bottoms effluent to the aromatic separation step;

d. passing the aromatic-lean fraction to a hydrotreating reaction zone operating under relatively low pressure to desulfurize at least a portion of aromatic-lean fraction and to produce a hydrotreated stream; and e. passing the hydrotreated stream to a fluid catalytic cracking reaction zone to produce a cracked product stream, a light cycle oil stream and a heavy cycle oil stream.

As used herein in relation to the system and process of the present invention, the term "labile" in conjunction with organosulfur and/or organonitrogen means those organosulfur and/or organonitrogen compounds that can be relatively easily desulfurized under mild conventional hydrodesulfurization pressure and temperature conditions, and the term "refractory" in conjunction with organosulfur and/or organonitrogen compounds means those organosulfur and/or organonitrogen compounds that are relatively more difficult to desulfurize under mild conventional hydrodesulfurization conditions.

Still other aspects, embodiments, and advantages of these exemplary aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. The accompanying drawings are included to provide illustration and a further understanding of the various aspects and embodiments, and are incorporated in and constitute a part of this specification. The drawings, together with the remainder of the specification, serve to explain principles and operations of the described and claimed aspects and embodiments.

BRIEF DESCRIPTION OF THE DRAWINGS

The foregoing summary as well as the following detailed description will be best understood when read in conjunction with the attached drawings. It should be understood, however, that the invention is not limited to the precise arrangements and apparatus shown. In the drawings the same or similar reference numerals are used to identify the same or similar elements, in which.

DETAILED DESCRIPTION OF THE INVENTION

The above objects and further advantages are provided by the apparatus and processes that combine selective hydrocracking and FCC operations to efficiently produce high quality hydrocarbon fuels.

For the purpose of this simplified schematic illustration and description, the numerous valves, temperature sensors, electronic controllers and the like that are customarily employed and well known to those of ordinary skill in the art of certain refinery operations are not included. Further, accompanying components that are in conventional refinery operations including FCC processes such as, for example, air supplies, catalyst hoppers and flue gas handling are not shown. In addition, accompanying components that are in conventional refinery operations including hydrocracking units such as, for example, bleed streams, spent catalyst discharge sub-systems, and catalyst replacement sub-systems are also not shown.

Figure 1:
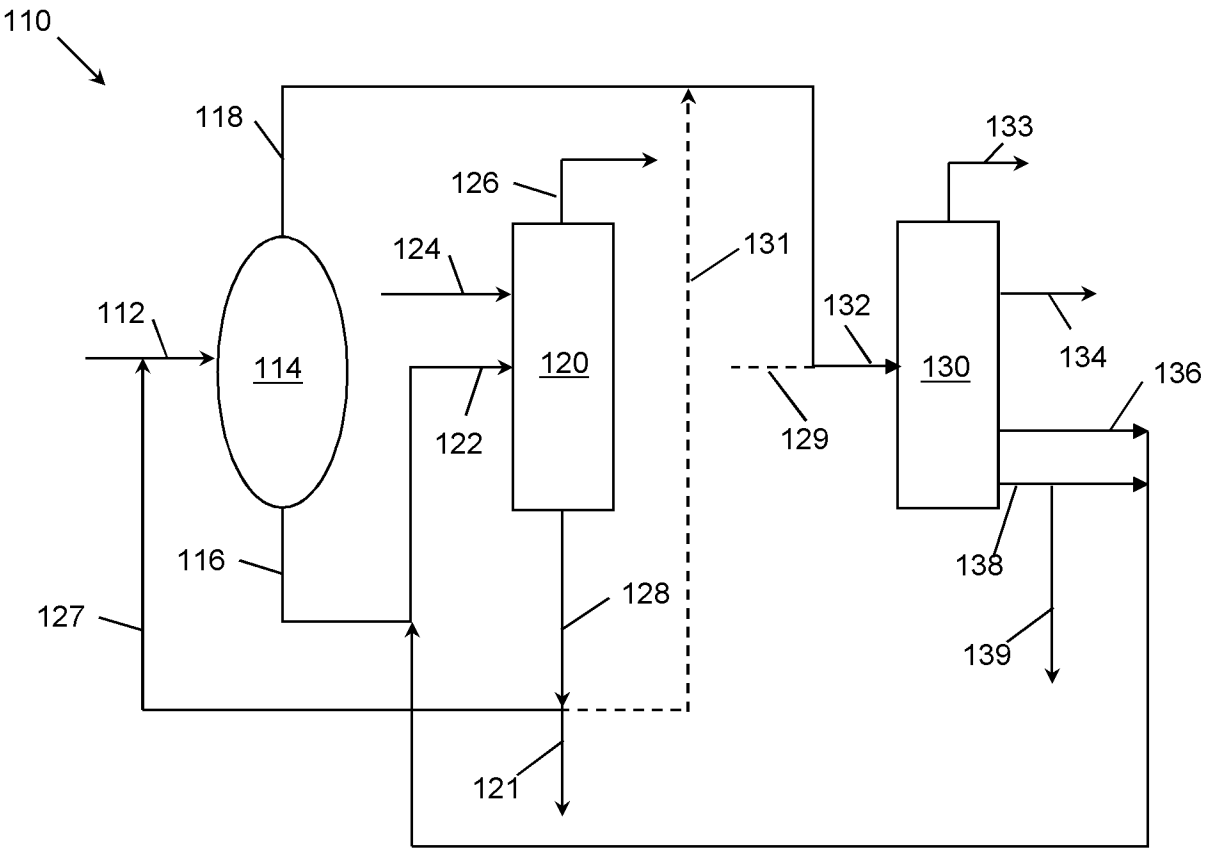
FIG. 1 is a process flow diagram of an integrated selective hydrocracking and FCC apparatus described herein.

Referring to FIG. 1, a process flow diagram of an integrated hydrocracking and FCC system 110 is provided. System 110 generally includes an aromatic separation zone 114, a hydrocracking zone 120 and an FCC reaction and separation zone 130.

Aromatic separation zone 114 generally includes a feed inlet 112, an aromatic-lean outlet 118 in fluid communication with FCC reaction and separation zone 130 and an aromatic-rich outlet 116 in fluid communication with hydrocracking zone 120. Various embodiments of aromatic separation zone 114 are detailed further herein in conjunction with FIGS. 5-11.

Hydrocracking zone 120 generally includes: an inlet 122 in fluid communication with aromatic-rich outlet 116 and cycle oil outlets 136, 138 from the FCC reaction and separation zone; a hydrogen gas inlet 124; a hydrocracked product outlet 126; and an unconverted bottoms outlet 128. Unconverted bottoms outlet 128 is in fluid communication with feed inlet 112 of aromatic separation zone 114 via a conduit 127 for further separation of aromatics and non-aromatics. In certain embodiments, unconverted bottoms outlet 128 is also in fluid communication with an inlet 132 of FCC reaction zone 130 via an optional conduit 131.

In general, FCC reaction and separation zone 130 includes a feed inlet 132 in fluid communication with aromatic-lean outlet 118 (and optionally unconverted bottoms outlet 128 via conduit 131). FCC reaction and separation zone 130 includes plural outlets for discharging products, partially cracked hydrocarbons, unreacted hydrocarbons and by-products. In particular, effluent from the FCC reactor is fractioned and discharged via a water and gas outlet 133, a cracked product outlet 134, a light cycle oil stream outlet 136 and a heavy cycle oil stream outlet 138. Light cycle oil stream outlet 136 and heavy cycle oil stream outlet 138 are in fluid communication with inlet 122 for further cracking reactions and/or heteroatom removal reactions in hydrocracking reaction zone 120.

During operation of system 110, a hydrocarbon stream is introduced via inlet 112 of aromatic separation zone 114 to be separated into an aromatic-lean stream discharged via an aromatic-lean outlet 118 and an aromatic-rich stream discharged from an aromatic-rich outlet 116. The aromatic-rich fraction generally includes a major proportion of the aromatic compounds that were in the initial feedstock and a minor proportion of non-aromatic compounds that were in the initial feedstock. The aromatic-lean fraction generally includes a major proportion of the non-aromatic compounds that were in the initial feedstock and a minor proportion of the aromatic compounds that were in the initial feedstock.

Unlike typical known methods, the present process separates the feed into fractions containing different classes of compounds with different reactivities relative to the conditions of hydrocracking. Conventionally, most approaches separately process different fractions of the feedstock, necessitating intermediate storage vessels and the like, or alternatively sacrifice overall yield to attain desirable process economics.

Since aromatic extraction operations typically do not provide sharp cut-offs between the aromatics and non-aromatics, the aromatic-lean fraction contains a major proportion of the non-aromatic content of the initial feed and a minor proportion of the aromatic content of the initial feed (e.g., a certain portion of the thiophene in the initial feed and short chain alkyl derivatives), and the aromatic-rich fraction contains a major proportion of the aromatic content of the initial feed and a minor proportion of the non-aromatic content of the initial feed. The amount of non-aromatics in the aromatic-rich fraction, and the amount of aromatics in the aromatic-lean fraction, depend on various factors as will be apparent to one of ordinary skill in the art, including the type of extraction, number of theoretical plates in the extractor (if applicable to the type of extraction), the type of solvent and the solvent ratio.

The feed portion that is extracted into the aromatic-rich fraction includes aromatic compounds that contain hetereoatoms and those that are free of hetereoatoms. Aromatic compounds that contain hetereoatoms that are extracted into the aromatic-rich fraction generally include aromatic sulfur compounds and aromatic nitrogen compounds. Organosulfur compounds extracted in the aromatic-rich fraction include a certain portion of the thiophene content from the feed, long chain alkylated derivatives of thiophene, benzothiophene, alkylated derivatives of benzothiophene, dibenzothiophene, alkyl derivatives of dibenzothiophene such as sterically hindered 4,6-dimethyl-dibenzothiophene, benzonaphtenothiophene, and alkyl derivatives of benzonaphtenothiophene. Organonitrogen compounds extracted in the aromatic-rich fraction include pyrrole, quinoline, acridines, carbazoles and their derivatives. These nitrogen- and sulfur-containing aromatic compounds are targeted in the aromatic separation step(s) generally by their solubility in the extraction solvent. In certain embodiments, selectivity of the nitrogen- and sulfur-containing aromatic compounds is enhanced by use of additional stages and/or selective sorbents. Various non-aromatic organosulfur compounds that may have been present in the initial feed, i.e., prior to hydrotreating, include mercaptans, sulfides and disulfides. Depending on the aromatic extraction operation type and/or condition, a preferably very minor portion of non-aromatic nitrogen- and sulfur-containing compounds can pass to the aromatic-rich fraction.

As used herein, the term "major proportion of the non-aromatic compounds" means at least greater than 50 W % of the non-aromatic content of the feed to the extraction zone, in certain embodiments at least greater than about 85 W %, and in further embodiments greater than at least about 95 W %. Also as used herein, the term "minor proportion of the non-aromatic compounds" means no more than 50 W % of the non-aromatic content of the feed to the extraction zone, in certain embodiments no more than about 15 W %, and in further embodiments no more than about 5 W %.

Also as used herein, the term "major proportion of the aromatic compounds" means at least greater than 50 W % of the aromatic content of the feed to the extraction zone, in certain embodiments at least greater than about 85 W %, and in further embodiments greater than at least about 95 W %. Also as used herein, the term "minor proportion of the aromatic compounds" means no more than 50 W % of the aromatic content of the feed to the extraction zone, in certain embodiments no more than about 15 W %, and in further embodiments no more than about 5 W %.

The aromatic-rich fraction is conveyed to inlet 122 of the hydrocracking reaction zone 120 operating under relatively high pressure to convert at least a portion of refractory aromatic organosulfur and organonitrogen compounds and to produce a hydrocracked product stream including via outlet 126, for instance, naphtha boiling in the nominal range of from about 36° C. to about 180° C. and diesel boiling in the nominal range of from about 180° C. to about 370° C. The hydrocracked product stream via outlet 126 contains a reduced level of organosulfur and organonitrogen compounds. The unconverted bottoms effluent is discharged via outlet 128. At least a portion of the unconverted bottoms effluent is recycled back to inlet 112 of the aromatic separation zone 114 via conduit 127. In certain embodiments, unconverted bottoms effluent is also passed to inlet 132 of the FCC reaction zone 130 via conduit 131. Further, a bleed stream 121 can also be discharged from outlet 128.

The aromatic-lean fraction contains a major proportion of the non-aromatic content of the initial feed and contains labile organosulfur and organonitrogen compounds, and a minor proportion of the aromatic content of the initial feed. The aromatic-lean fraction is conveyed to inlet 132 of the FCC reaction zone 130 to produce a FCC cracked product stream via outlet 134, a light cycle oil stream via outlet 136 and a heavy cycle oil stream via outlet 138. The resulting product gasoline via outlet 134 contains a reduced level of organosulfur compounds.

In certain embodiments, both light and heavy cycle oil can be discharged via a single outlet with an optional bleed stream associated with the combined light and heavy cycle oil stream. Gasoline and optionally other products such as olefins are recovered and collected as final or intermediate products, i.e., that can be subjected to further downstream separation and/or processing.

Cycle oil, including light cycle oil from FCC reaction and separation zone outlet 136 and heavy cycle oil from FCC reaction and separation zone outlet 138, are combined and passed to inlet 122 of hydrocracking zone 120. A bleed stream 139, which is a slurry oil stream that is heavier than the heavy cycle oil stream and typically contains catalyst particles, can also be discharged from the FCC reaction and separation zone 130.

In additional embodiments, a source of feedstock that is separate from the feedstock introduced to hydrocracking reaction zone 120 is optionally conveyed into FCC reaction and separation zone 130, e.g., via a conduit 129. This feedstock can be the same or different in its characteristics than the feedstock to introduced to hydrocracking reaction zone 120. In certain embodiments, the feedstock introduced via conduit 129 is treated vacuum gas oil having low sulfur and nitrogen content. In addition, steam can be integrated with the feed to FCC reaction and separation zone 130 to atomize or disperse the feed into the FCC reactor unit.

Figure 2:
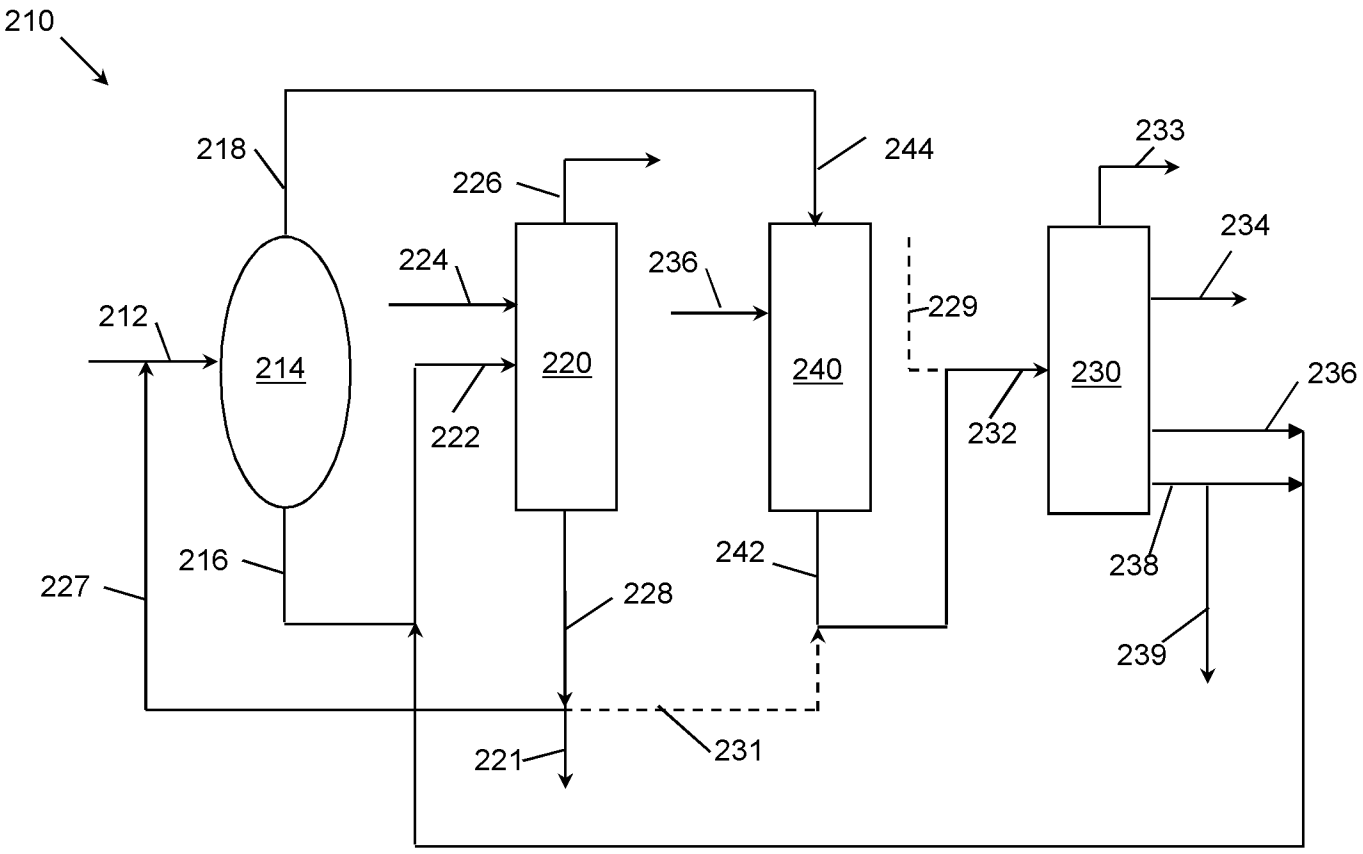
FIG. 2 is a process flow diagram of an integrated selective hydrocracking, hydrotreating and FCC apparatus described herein.

Referring to FIG. 2, an integrated system 210 according to the present invention is schematically illustrated. In general, system 210 includes an aromatic separation zone 214, a hydrocracking reaction zone 220, a hydrotreating reaction zone 240 and an FCC reaction and separation zone 230.

Aromatic separation zone 214 includes a feed inlet 212, an aromatic-lean outlet 218 and an aromatic-rich outlet 216. Various embodiments of unit operations contained within aromatic separation zone 214 are detailed further herein in conjunction with FIGS. 5-11.

Hydrocracking reaction zone 220 includes an inlet 222 in fluid communication with aromatic-rich outlet 216, a hydrogen gas inlet 224, a hydrocracked product outlet 226 and an unconverted bottoms outlet 228. Unconverted bottoms outlet 228 is in fluid communication with feed inlet 212 to recycle unconverted bottoms to aromatic separation zone 214 via a conduit 227 for further separation of aromatics and non-aromatics. In certain embodiments, unconverted bottoms outlet 228 is also in fluid communication with an inlet 232 of FCC reaction and separation zone 230 via an optional conduit 231.

Hydrotreating reaction zone 240 includes an inlet 244 in fluid communication with aromatic-lean outlet 218, a hydrogen gas inlet 246 and a hydrotreated effluent outlet 242.

FCC reaction and separation zone 230 includes inlet 232 in fluid communication with hydrotreated effluent outlet 242 (and optionally unconverted bottoms outlet 228 via conduit 231). FCC reaction and separation zone 230 includes plural outlets for discharging products, partially cracked hydrocarbons, unreacted hydrocarbons and by-products. In particular, effluent from the FCC reactor is fractioned and discharged via a water and gas outlet 233, a FCC cracked product outlet 234, a light cycle oil stream outlet 236 and a heavy cycle oil stream outlet 238. Light cycle oil stream outlet 236 and heavy cycle oil stream outlet 238 are in fluid communication with inlet 222 for further cracking reactions and/or heteroatom removal reactions in hydrocracking reaction zone 220.

During operation of system 210, a hydrocarbon stream is introduced via inlet 212 of aromatic separation zone 214 to be separated into an aromatic-lean stream discharged via an aromatic-lean outlet 218 and an aromatic-rich stream discharged from an aromatic-rich outlet 216. The aromatic-rich fraction from the aromatic extraction zone 214 generally includes a major proportion of the aromatic content of the initial feedstock and a minor proportion of the non-aromatic content of the initial feedstock. The aromatic-lean fraction generally includes a major proportion of the non-aromatic compounds that were in the initial feedstock and a minor proportion of the aromatic compounds that were in the initial feedstock.

The aromatic-rich fraction is conveyed to inlet 222 of the hydrocracking reaction zone 220 operating under relatively high pressure to convert at least a portion of refractory aromatic organosulfur and organonitrogen compounds and to produce a hydrocracked product stream including via outlet 126, for instance, naphtha boiling in the nominal range of from about 36° C. to about 180° C. and diesel boiling in the nominal range of from about 180° C. to about 370° C. The hydrocracked product stream via outlet 226 contains a reduced level of organosulfur and organonitrogen compounds. The unconverted bottoms effluent is discharged via outlet 228. At least a portion of the unconverted bottoms effluent is recycled back to inlet 212 of the aromatic separation zone 214 via conduit 227. In certain embodiments, unconverted bottoms effluent is also passed to inlet 232 of the FCC reaction zone 230 via conduit 231. Further, a bleed stream 221 can also be discharged from outlet 228.

The aromatic-lean fraction contains a major proportion of the non-aromatic content of the initial feed and contains labile organosulfur and organonitrogen compounds, and a minor proportion of the aromatic content of the initial feed. The aromatic-lean fraction is conveyed to inlet 244 of the hydrotreating reaction zone 240 operating under relatively low pressure to desulfurize aromatic-lean fraction and to discharge a hydrotreated effluent via outlet 242.

The hydrotreated effluent is conveyed to inlet 232 of the FCC reaction zone 230 to discharge a FCC cracked product stream via outlet 234, a light cycle oil stream via outlet 236 and a heavy cycle oil stream via outlet 238. The resulting product gasoline via outlet 244 contains a reduced level of organosulfur compounds.

As noted with respect to system 110, cycle oil, including light cycle oil from FCC reaction and separation zone outlet 236 and heavy cycle oil from FCC reaction and separation zone outlet 238, are combined and passed to inlet 222 of hydrocracking zone 220. A bleed stream 239, which is a slurry oil stream that is heavier than the heavy cycle oil stream and typically contains catalyst particles, can also be discharged from the FCC reaction and separation zone 230.

In additional embodiments, a source of feedstock that is separate from the feedstock introduced to hydrocracking reaction zone 220 is optionally conveyed into FCC reaction and separation zone 130, e.g., via a conduit 229. This feedstock can be the same or different in its characteristics than the feedstock to introduced to hydrocracking reaction zone 220. In certain embodiments, the feedstock introduced via conduit 229 is treated vacuum gas oil having low sulfur and nitrogen content. In addition, steam can be integrated with the feed to FCC reaction and separation zone 230 to atomize or disperse the feed into the FCC reactor unit.

The initial feedstock for use in above-described apparatus and process can be a crude or partially refined oil product obtained from various sources. The source of feedstock can be crude oil, synthetic crude oil, bitumen, oil sand, shale oil, coal liquids, or a combination including one of the foregoing sources. For example, the feedstock can be a straight run gas oil or other refinery intermediate stream such as vacuum gas oil, deasphalted oil and/or demetalized oil obtained from a solvent deasphalting process, light coker or heavy coker gas oil obtained from a coker process, cycle oil obtained from an FCC process separate from the integrated FCC process described herein, gas oil obtained from a visbreaking process, or any combination of the foregoing products. In certain embodiments, vacuum gas oil is a suitable feedstock for the integrated process. A suitable feedstock contains hydrocarbons having boiling point of from about 36° C. to about 900° C. and in certain embodiments in the range of from about 350° C. to about 565° C.

Suitable hydrocracking reaction apparatus include fixed bed reactors, moving bed reactor, ebullated bed reactors, baffle-equipped slurry bath reactors, stirring bath reactors, rotary tube reactors, slurry bed reactors, or other suitable reaction apparatus as will be appreciated by one of ordinary skill in the art. In certain embodiments, and in particular for vacuum gas oil and similar feedstocks, fixed bed reactors are utilized. In additional embodiments, and in particular for heavier feedstocks and other difficult to crack feedstocks, ebullated bed reactors are utilized.

In general, the operating conditions for the reactor in a hydrocracking reaction zone include:

reaction temperature of from about 300° C. to about 500° C. and in certain embodiments about 330° C. to about 420° C.;

hydrogen partial pressure of from about 60 Kg/cm' to about 200 Kg/cm' and in certain embodiments about 60 Kg/cm' to about 140 $Kg/cm^2$; and hydrogen feed rate of up to about 2500 standard liters per liter of hydrocarbon feed (SLt/Lt), in certain embodiments from about 500 to 2500 SLt/Lt, and in further embodiments from about 1000 to 1500 SLt/Lt.

A hydrocracking catalyst may include any one of or combination including amorphous alumina catalysts, amorphous silica alumina catalysts, zeolite based catalyst. The hydrocracking catalyst can possess an active phase material including, in certain embodiments, any one of or combination including Ni, W, Mo, or Co.

Suitable hydrotreating reaction apparatus (e.g., for use in hydrotreating reaction zone 240) include fixed bed reactors, moving bed reactor, ebullated bed reactors, baffle-equipped slurry bath reactors, stirring bath reactors, rotary tube reactors, slurry bed reactors, or other suitable reaction apparatus as will be appreciated by one of ordinary skill in the art.

In general, the operating conditions for the reactor in a hydrotreating reaction zone include a reaction temperature in the range of from about 300° C. to about 500° C., and in certain embodiments about 320° C. to about 380° C.; and operating pressure in the range of from about 20 bars to about 100 bars, and in certain embodiments about 30 bars to about 60 bars.

The hydrotreating zone utilizes hydrotreating catalyst having one or more active metal components selected from the Periodic Table of the Elements Group VI, VII or VIIIB. In certain embodiments the active metal component is one or more of cobalt, nickel, tungsten and molybdenum, typically deposited or otherwise incorporated on a support, e.g., alumina, silica alumina, silica, or zeolites. In certain embodiments, the hydrotreating catalyst used in the first hydrotreating zone, i.e., operating under mild conditions, includes a combination of cobalt and molybdenum deposited on an alumina substrate.

Catalytic cracking reactions occur in FCC reaction zone 130 or 230 under conditions that promote formation of gasoline or olefins and that minimize olefin-consuming reactions, such as hydrogen-transfer reactions. These conditions generally depend on the type and configuration of the FCC unit.

Various types of FCC reactors operate under conditions that promote formation of olefins and gasoline are known, including the HS-FCC process developed by Nippon Oil Corporation of Japan, Deep Catalytic Cracking (DCC-I and DCC-II) and Catalytic Pyrolysis Process developed by SINOPEC Research Institute of Petroleum Processing of Beijing, China, the Indmax process developed by Indian Oil Corporation of India, MAXOFIN™ developed by Exxon-Mobil of Irving, Tex., USA and KBR, Inc. of Houston, Tex., USA, NExCC™ developed by Fortum Corporation of Fortum, Finland, PetroFCC developed by UOP LLC of Des Plaines, Ill., USA, Selective Component Cracking developed by ABB Lummus Global, Inc. of Bloomfield, N.J., USA, High-Olefins FCC developed by Petrobras of Brazil, and Ultra Selective Cracking developed by Stone & Webster, Incorporated of Stoughton, Mass., USA.

In certain embodiments, a suitable HS-FCC unit operation includes a downflow reactor and is characterized by high reaction temperature, short contact time and high catalyst to oil ratio. A downflow reactor permits higher catalyst to oil ratio because the requirement to lift the catalyst by vaporized feed is not required. Reaction temperatures are in the range of from about 550° C. to about 650° C., which is higher than conventional FCC reaction temperatures. Under these reaction temperatures, two competing cracking reactions, thermal cracking and catalytic cracking, occur. Thermal cracking contributes to the formation of lighter products, mainly dry gas and coke, while catalytic cracking increases propylene yield. Therefore, the residence time in the downflow reactor is relatively short, e.g., less than about 1 second, and in certain embodiments about 0.2-0.7 seconds, to minimize thermal cracking. Undesirable secondary reactions such as hydrogen-transfer reactions, which consume olefins, are suppressed due to the very short residence times. To maximize conversion during the short residence time, a high catalyst to oil ratio is used, e.g., greater than 20:1, and catalysts and the feedstock are admixed and dispersed at the reactor inlet and separated immediately at the reactor outlet.

Figure 3:
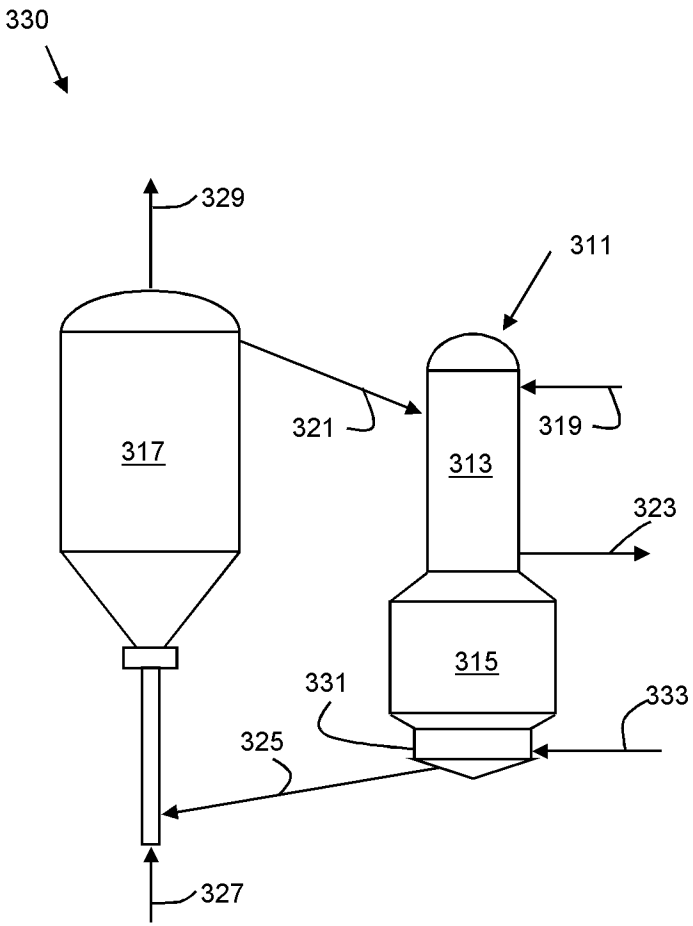
FIG. 3 is a generalized diagram of a downflow FCC reactor apparatus.

In certain embodiments, an FCC unit configured with a downflow reactor is provided that operates under conditions that promote formation of olefins and that minimize olefin-consuming reactions, such as hydrogen-transfer reactions. FIG. 3 is a generalized process flow diagram of an FCC unit 330 which includes a downflow reactor and can be used in the hybrid system and process according to the present invention. FCC unit 330 includes a reactor/separator 311 having a reaction zone 313 and a separation zone 315. FCC unit 330 also includes a regeneration zone 317 for regenerating spent catalyst.

In particular, a charge 319 is introduced to the reaction zone, in certain embodiments also accompanied by steam or other suitable gas for atomization of the feed. An effective quantity of heated fresh or hot regenerated solid cracking catalyst particles from regeneration zone 317 is also transferred, e.g., through a downwardly directed conduit or pipe 321, commonly referred to as a transfer line or standpipe, to a withdrawal well or hopper (not shown) at the top of reaction zone 313. Hot catalyst flow is typically allowed to stabilize in order to be uniformly directed into the mix zone or feed injection portion of reaction zone 313.

The bottoms fraction from the fractionating zone serves as the charge to the FCC unit 330, alone or in combination with an additional feed as discussed above. The charge is injected into a mixing zone through feed injection nozzles typically situated proximate to the point of introduction of the regenerated catalyst into reaction zone 313. These multiple injection nozzles result in the catalyst and oil mixing thoroughly and uniformly. Once the charge contacts the hot catalyst, cracking reactions occur. The reaction vapor of hydrocarbon cracked products, unreacted feed and catalyst mixture quickly flows through the remainder of reaction zone 313 and into a rapid separation zone 315 at the bottom portion of reactor/separator 311. Cracked and uncracked hydrocarbons are directed through a conduit or pipe 323 to a conventional product recovery section known in the art.

If necessary for temperature control, a quench injection can be provided near the bottom of reaction zone 313 immediately before the separation zone 315. This quench injection quickly reduces or stops the cracking reactions and can be utilized for controlling cracking severity and allows for added process flexibility.

The reaction temperature, i.e., the outlet temperature of the downflow reactor, can be controlled by opening and closing a catalyst slide valve (not shown) that controls the flow of regenerated catalyst from regeneration zone 317 into the top of reaction zone 313. The heat required for the endothermic cracking reaction is supplied by the regenerated catalyst. By changing the flow rate of the hot regenerated catalyst, the operating severity or cracking conditions can be controlled to produce the desired yields of light olefinic hydrocarbons and gasoline.

A stripper 331 is also provided for separating oil from the catalyst, which is transferred to regeneration zone 317. The catalyst from separation zone 315 flows to the lower section of the stripper 331 that includes a catalyst stripping section into which a suitable stripping gas, such as steam, is introduced through streamline 333. The stripping section is typically provided with several baffles or structured packing (not shown) over which the downwardly flowing catalyst passes counter-currently to the flowing stripping gas. The upwardly flowing stripping gas, which is typically steam, is used to "strip" or remove any additional hydrocarbons that remain in the catalyst pores or between catalyst particles.

The stripped or spent catalyst stream 325 is transported by lift forces from the combustion air stream 327 through a lift riser of the regeneration zone 317. This spent catalyst, which can also be contacted with additional combustion air, undergoes controlled combustion of any accumulated coke. Flue gases are removed from the regenerator via conduit 329. In the regenerator, the heat produced from the combustion of the by-product coke is transferred to the catalyst stream 321 raising the temperature required to provide heat for the endothermic cracking reaction in the reaction zone 313.

In one embodiment, a suitable FCC unit 330 that can be integrated in the present invention that promotes formation of olefins and that minimizes olefin-consuming reactions includes a HS-FCC reactor, can be similar to those described in U.S. Pat. No. 6,656,346, and US Patent Publication Number 2002/0195373, both of which are incorporated herein by reference. Important properties of downflow reactors include introduction of feed at the top of the reactor with downward flow, shorter residence time as compared to riser reactors, and high catalyst to oil ratio, e.g., in the range of from about 20:1 to about 30:1.

In general, the operating conditions for the reactor of a suitable downflow FCC unit include: reaction temperature of from about 550° C. to about 650° C., in certain embodiments about 580° C. to about 630° C., and in further embodiments about 590° C. to about 620° C.;

reaction pressure of from about 1 $Kg/cm^2$ to about 20 $Kg/cm^2$, in certain embodiments about 1 $Kg/cm^2$ to about 10 $Kg/cm^2$, in further embodiments about 1 $Kg/cm^2$ to about 3 $Kg/cm^2$;

contact time (in the reactor) of from about 0.1 seconds to about 30 seconds, in certain embodiments about 0.1 seconds to about 10 seconds, and in further embodiments about 0.2 seconds to about 0.7 seconds; and a catalyst to feed ratio of from about 1:1 to about 40:1, in certain embodiments about 1:1 to about 30:1, and in further embodiments about 10:1 to about 30:1.

Figure 4:
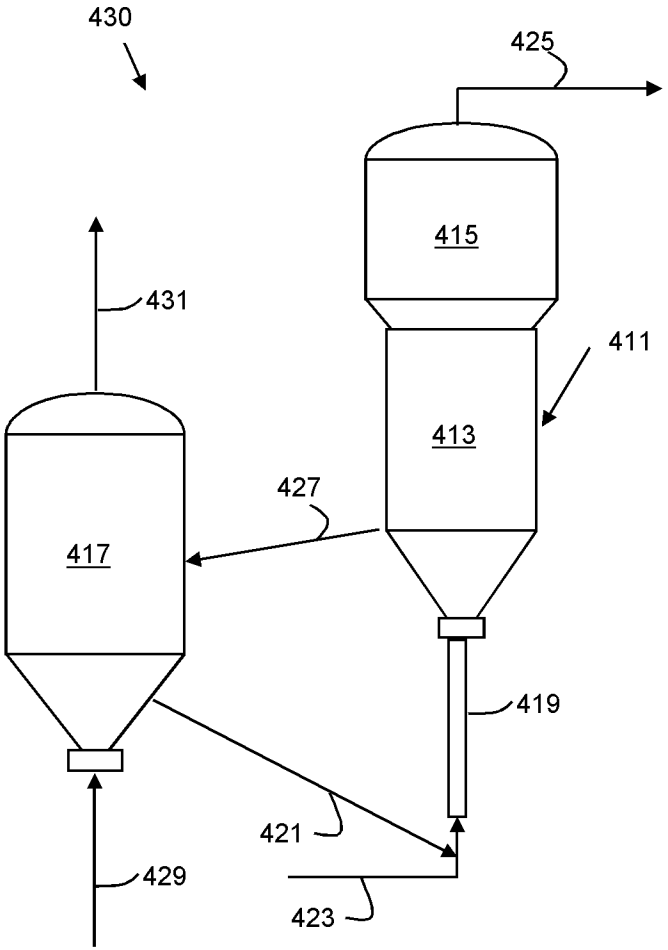
FIG. 4 is a generalized diagram of a riser FCC reactor apparatus.

In certain embodiments, an FCC unit configured with a riser reactor is provided that operates under conditions that promote formation of olefins and that minimizes olefin-consuming reactions, such as hydrogen-transfer reactions. FIG. 4 is a generalized process flow diagram of an FCC unit 430 which includes a riser reactor and can be used in the hybrid system and process according to the present invention. FCC unit 430 includes a reactor/separator 411 having a riser portion 419, a reaction zone 413 and a separation zone 415. FCC unit 430 also includes a regeneration vessel 417 for regenerating spent catalyst.

Hydrocarbon feedstock is conveyed via a conduit 423, and in certain embodiments also accompanied by steam or other suitable gas for atomization of the feed, for admixture and intimate contact with an effective quantity of heated fresh or regenerated solid cracking catalyst particles which are conveyed via a conduit 421 from regeneration vessel 417. The feed mixture and the cracking catalyst are contacted under conditions to form a suspension that is introduced into the riser 419.

In a continuous process, the mixture of cracking catalyst and hydrocarbon feedstock proceed upward through the riser 419 into reaction zone 413. In riser 419 and reaction zone 413, the hot cracking catalyst particles catalytically crack relatively large hydrocarbon molecules by carbon-carbon bond cleavage.

During the reaction, as is conventional in FCC operations, the cracking catalysts become coked and hence access to the active catalytic sites is limited or nonexistent. Reaction products are separated from the coked catalyst using any suitable configuration known in FCC units, generally referred to as the separation zone 415 in FCC unit 430, for instance, located at the top of the reactor 411 above the reaction zone 413. The separation zone can include any suitable apparatus known to those of ordinary skill in the art such as, for example, cyclones. The reaction product is withdrawn through conduit 425.

Catalyst particles containing coke deposits from fluid cracking of the hydrocarbon feedstock pass from the separation zone 413 through a conduit 427 to regeneration zone 417. In regeneration zone 417, the coked catalyst comes into contact with a stream of oxygen-containing gas, e.g., pure oxygen or air, which enters regeneration zone 417 via a conduit 429. The regeneration zone 417 is operated in a configuration and under conditions that are known in typical FCC operations. For instance, regeneration zone 417 can operate as a fluidized bed to produce regeneration off-gas comprising combustion products which is discharged through a conduit 431. The hot regenerated catalyst is transferred from regeneration zone 417 through conduit 421 to the bottom portion of the riser 419 for admixture with the hydrocarbon feedstock and noted above.

In one embodiment, a suitable FCC unit 430 that can be integrated in the present invention that promotes formation of olefins and that minimizes olefin-consuming reactions includes a HS-FCC reactor, can be similar to that described in U.S. Pat. Nos. 7,312,370, 6,538,169, and 5,326,465.

In general, the operating conditions for the reactor of a suitable riser FCC unit include:

reaction temperature of from about 480° C. to about 650° C., in certain embodiments about 500° C. to about 620° C., and in further embodiments about 500° C. to about 600° C.;

reaction pressure of from about 1 $Kg/cm^2$ to about 20 $Kg/cm^2$, in certain embodiments about 1 $Kg/cm^2$ to about 10 $Kg/cm^2$, in further embodiments about 1 $Kg/cm^2$ to about 3 $Kg/cm^2$;

contact time (in the reactor) of from about 0.7 seconds to about 10 seconds, in certain embodiments about 1 second to about 5 seconds, in further embodiments about 1 second to about 2 seconds; and a catalyst to feed ratio of from about 1:1 to about 15:1, in certain embodiments about 1:1 to about 10:1, in further embodiments about 8:1 to about 20:1.

A catalyst that is suitable for the particular charge and the desired product is conveyed to the fluidized catalytic cracking reactor within the FCC reaction and separation zone. In certain embodiments, to promote formation of olefins and minimize olefin-consuming reactions, such as hydrogen-transfer reactions, an FCC catalyst mixture is used in the FCC reaction and separation zone, including an FCC base catalyst and an FCC catalyst additive.

In particular, a matrix of a base cracking catalyst can include natural or synthetic zeolites including one or more Y-zeolite, clays such as kaolin, montmorilonite, halloysite and bentonite, and/or one or more inorganic porous oxides such as alumina, silica, boria, chromia, magnesia, zirconia, titania and silica-alumina. A suitable base cracking catalyst has a bulk density of 0.5 g/ml to 1.0 g/ml, an average particle diameter of 50 microns to 90 microns, a surface area of 50 $m^2/g$ to 350 $m^2/g$ and a pore volume of 0.05 ml/g to 0.5 ml/g.

A suitable catalyst mixture contains, in addition to a base cracking catalyst, an additive containing a shape-selective zeolite. The shape selective zeolite referred to herein means a zeolite whose pore diameter is smaller than that of Y-type zeolite, so that hydrocarbons with only limited shape can enter the zeolite through its pores. Suitable shape-selective zeolite components include ZSM-5 zeolite, zeolite omega, SAPO-5 zeolite, SAPO-11 zeolite, SAPO34 zeolite, and pentasil-type aluminosilicates. The content of the shape-selective zeolite in the additive is generally in the range of from about 20 W % to 70 W %, and in certain embodiments from about 30 W % to 60 W %.

A suitable additive possesses a bulk density of 0.5 g/ml to 1.0 g/ml, an average particle diameter of 50 microns to 90 microns, a surface area of 10 $m^2/g$ to 200 $m^2/g$ and a pore volume of 0.01 ml/g to 0.3 ml/g.

A percentage of the base cracking catalyst in the catalyst mixture can be in the range of 60 to 95 W % and a percentage of the additive in the catalyst mixture is in a range of 5 to 40 W %. If the percentage of the base cracking catalyst is lower than 60 W % or the percentage of additive is higher than 40 W %, high light-fraction olefin yield cannot be obtained, because of low conversions of the feed oil. If the percentage of the base cracking catalyst is higher than 95 W %, or the percentage of the additive is lower than 5 W %, high light-fraction olefin yield cannot be obtained, while high conversion of the feed oil can be achieved. For the purpose of this simplified schematic illustration and description, the numerous valves, temperature sensors, electronic controllers and the like that are customarily employed and well known to those of ordinary skill in the art of fluid catalyst cracking are not included. Accompanying components that are in conventional hydrocracking units such as, for example, bleed streams, spent catalyst discharge sub-systems, and catalyst replacement sub-systems are also not shown. Further, accompanying components that are in conventional FCC systems such as, for example, air supplies, catalyst hoppers and flue gas handling are not shown.

The aromatic separation apparatus is generally based on selective aromatic extraction. For instance, the aromatic separation apparatus can be a suitable solvent extraction aromatic separation apparatus capable of partitioning the feed into a generally aromatic-lean stream and a generally aromatic-rich stream. Systems including various established aromatic extraction processes and unit operations used in other stages of various refinery and other petroleum-related operations can be employed as the aromatic separation apparatus described herein. In certain existing processes, it is desirable to remove aromatics from the end product, e.g., lube oils and certain fuels, e.g., diesel fuel. In other processes, aromatics are extracted to produce aromatic-rich products, for instance, for use in various chemical processes and as an octane booster for gasoline.

Figure 5:
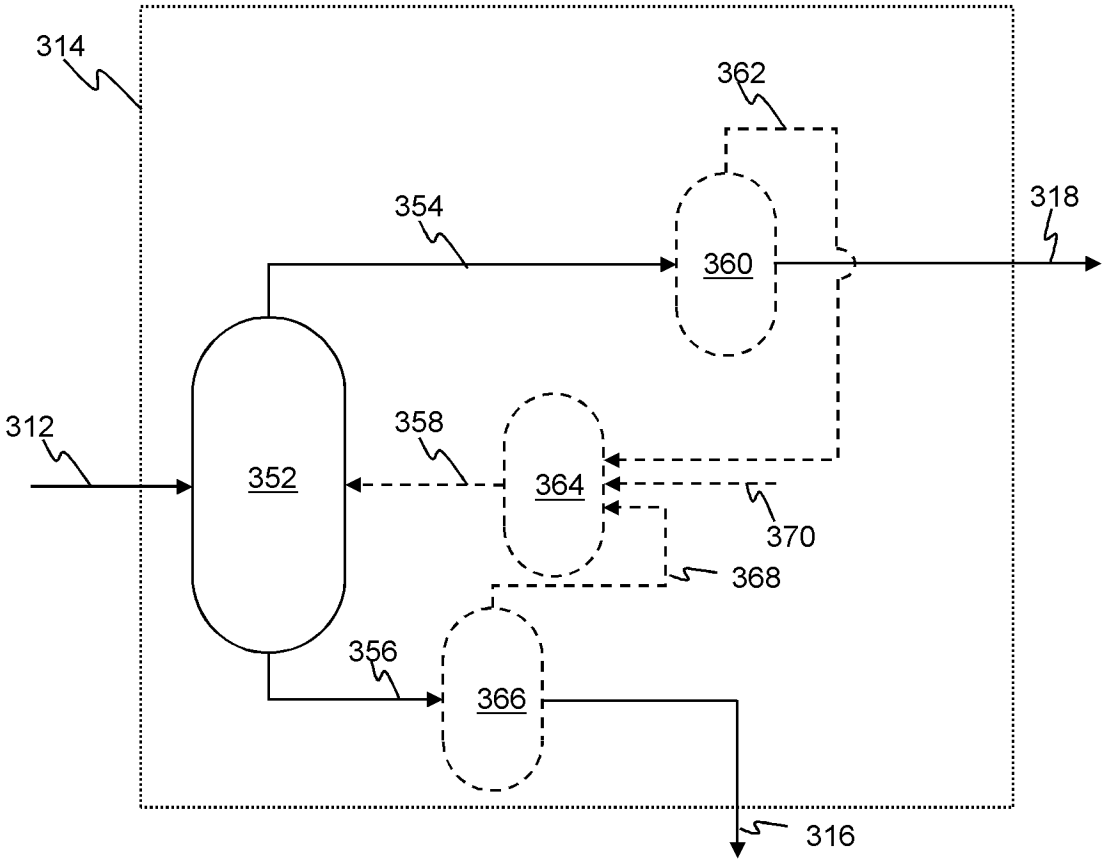
FIG. 5 is a schematic diagram of an aromatic separation zone.

As shown in FIG. 5, an aromatic separation apparatus 314 can include suitable unit operations to perform a solvent extraction of aromatics, and recover solvents for reuse in the process. A feed 312 is conveyed to an aromatic extraction vessel 352 in which an aromatic-lean fraction is separated as a raffinate stream 354 from an aromatic-rich fraction as an extract stream 356. A solvent feed 358 is introduced into the aromatic extraction vessel 352.

A portion of the extraction solvent can also exist in stream 354, e.g., in the range of from about 0 W % to about 15 W % (based on the total amount of stream 354), in certain embodiments less than about 8 W %. In operations in which the solvent existing in stream 354 exceeds a desired or predetermined amount, solvent can be removed from the hydrocarbon product, for example, using a flashing or stripping unit 360, or other suitable apparatus. Solvent 362 from the flashing unit 360 can be recycled to the aromatic extraction vessel 352, e.g., via a surge drum 364. Initial solvent feed or make-up solvent can be introduced via stream 370. An aromatic-lean stream 318 is discharged from the flashing unit 360.

In addition, a portion of the extraction solvent can also exist in stream 356, e.g., in the range of from about 70 W % to about 98 W % (based on the total amount of stream 358), in certain embodiments less than about 85 W %. In embodiments in which solvent existing in stream 356 exceeds a desired or predetermined amount, solvent can be removed from the hydrocarbon product, for example, using a flashing or stripping unit 366 or other suitable apparatus. Solvent 368 from the flashing unit 366 can be recycled to the aromatic extraction vessel 352, e.g., via the surge drum 364. An aromatic-rich stream 316 is discharged from the flashing unit 366.

Selection of solvent, operating conditions, and the mechanism of contacting the solvent and feed 312 permit control over the level of aromatic extraction. For instance, suitable solvents include furfural, N-methyl-2-pyrrolidone, dimethylformamide, dimethylsulfoxide, phenol, nitrobenzene, sulfolanes, acetonitrile, furfural, or glycols, and can be provided in a solvent to oil ratio of from about 20:1, in certain embodiments about 4:1, and in further embodiments about 1:1. Suitable glycols include diethylene glycol, ethylene glycol, triethylene glycol, tetraethylene glycol and dipropylene glycol. The extraction solvent can be a pure glycol or a glycol diluted with from about 2 to 10 W % water. Suitable sulfolanes include hydrocarbon-substituted sulfolanes (e.g., 3-methyl sulfolane), hydroxy sulfolanes (e.g., 3-sulfolanol and 3-methyl-4-sulfolanol), sulfolanyl ethers (e.g., methyl-3-sulfolanyl ether), and sulfolanyl esters (e.g., 3-sulfolanyl acetate).

The aromatic separation apparatus can operate at a temperature in the range of from about 20° C. to about 200° C., and in certain embodiments about 40° C. to about 80° C. The operating pressure of the aromatic separation apparatus can be in the range of from about 1 bar to about 10 bars, and in certain embodiments, about 1 bar to 3 bars. Types of apparatus useful as the aromatic separation apparatus of the present invention include stage-type extractors or differential extractors.

Figure 6:
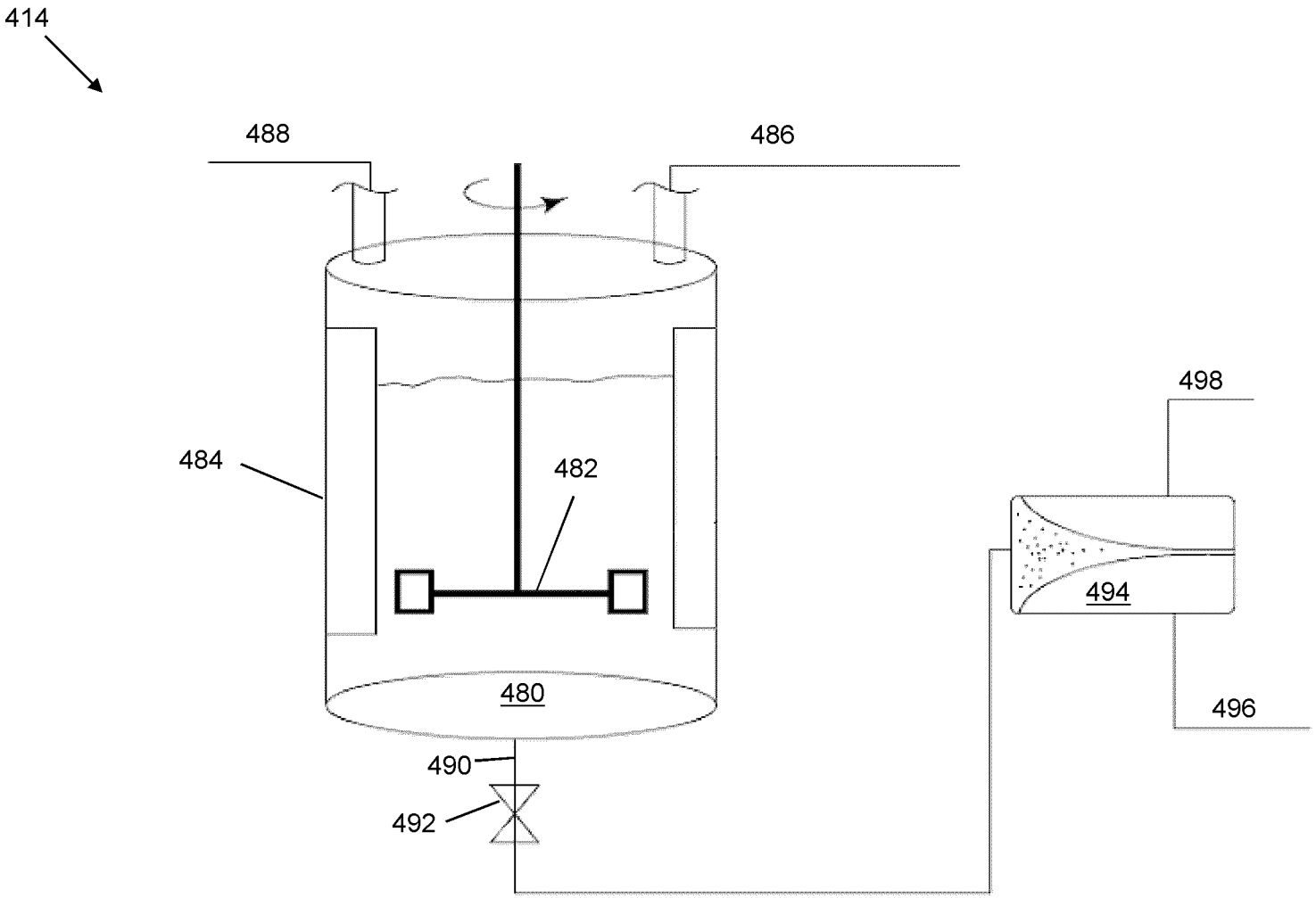
FIGS. 6-11 show various examples of apparatus suitable for use as the aromatic extraction zone.

An example of a stage-type extractor is a mixer-settler apparatus 414 schematically illustrated in FIG. 6. Mixer-settler apparatus 414 includes a vertical tank 480 incorporating a turbine or a propeller agitator 482 and one or more baffles 484. Charging inlets 486, 488 are located at the top of tank 480 and outlet 490 is located at the bottom of tank 480. The feedstock to be extracted is charged into vessel 480 via inlet 486 and a suitable quantity of solvent is added via inlet 488. The agitator 482 is activated for a period of time sufficient to cause intimate mixing of the solvent and charge stock, and at the conclusion of a mixing cycle, agitation is halted and, by control of a valve 492, at least a portion of the contents are discharged and passed to a settler 494. The phases separate in the settler 494 and a raffinate phase containing an aromatic-lean hydrocarbon mixture and an extract phase containing an aromatic-rich mixture are withdrawn via outlets 496 and 498, respectively. In general, a mixer-settler apparatus can be used in batch mode, or a plurality of mixer-settler apparatus can be staged to operate in a continuous mode.

Another stage-type extractor is a centrifugal contactor. Centrifugal contactors are high-speed, rotary machines characterized by relatively low residence time. The number of stages in a centrifugal device is usually one, however, centrifugal contactors with multiple stages can also be used. Centrifugal contactors utilize mechanical devices to agitate the mixture to increase the interfacial area and decrease the mass transfer resistance.

Various types of differential extractors (also known as "continuous contact extractors,") that are also suitable for use as an aromatic extraction apparatus in zone 114 or 214 of the present invention include, but are not limited to, centrifugal contactors and contacting columns such as tray columns, spray columns, packed towers, rotating disc contactors and pulse columns.

Contacting columns are suitable for various liquid-liquid extraction operations. Packing, trays, spray or other droplet-formation mechanisms or other apparatus are used to increase the surface area in which the two liquid phases (i.e., a solvent phase and a hydrocarbon phase) contact, which also increases the effective length of the flow path. In column extractors, the phase with the lower viscosity is typically selected as the continuous phase, which, in the case of an aromatic extraction apparatus, is the solvent phase. In certain embodiments, the phase with the higher flow rate can be dispersed to create more interfacial area and turbulence. This is accomplished by selecting an appropriate material of construction with the desired wetting characteristics. In general, aqueous phases wet metal surfaces and organic phases wet non-metallic surfaces. Changes in flows and physical properties along the length of an extractor can also be considered in selecting the type of extractor and/or the specific configuration, materials or construction, and packing material type and characteristics (i.e., average particle size, shape, density, surface area, and the like).

Figure 7:
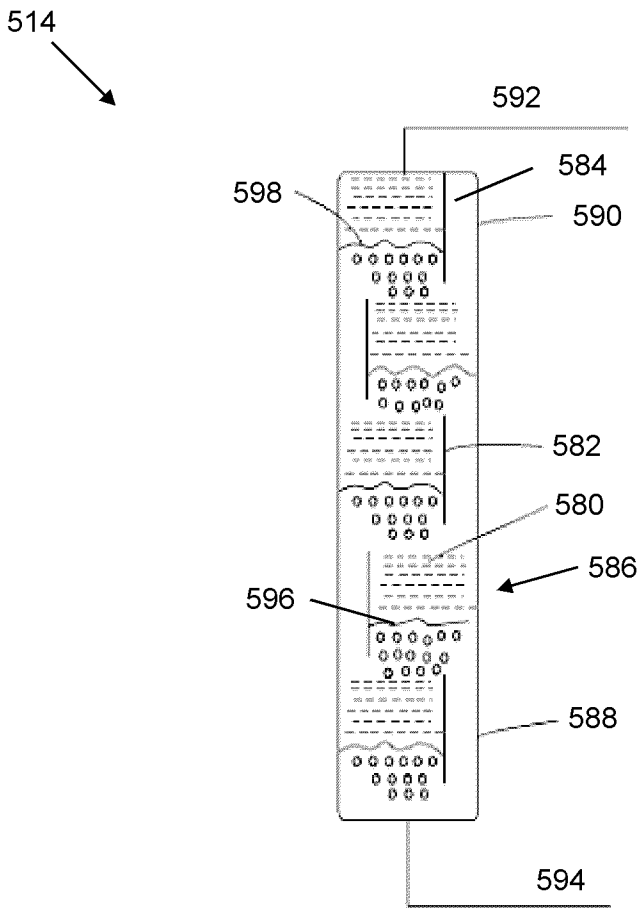

A tray column 514 is schematically illustrated in FIG. 7. A light liquid inlet 588 at the bottom of column 514 receives liquid hydrocarbon, and a heavy liquid inlet 590 at the top of column 514 receives liquid solvent. Column 514 includes a plurality of trays 580 and associated downcomers 582. A top level baffle 584 physically separates incoming solvent from the liquid hydrocarbon that has been subjected to prior extraction stages in the column 514. Tray column 514 is a multi-stage counter-current contactor. Axial mixing of the continuous solvent phase occurs at region 586 between trays 580, and dispersion occurs at each tray 580 resulting in effective mass transfer of solute into the solvent phase. Trays 580 can be sieve plates having perforations ranging from about 1.5 to 4.5 mm in diameter and can be spaced apart by about 150-600 mm.

Light hydrocarbon liquid passes through the perforation in each tray 580 and emerges in the form of fine droplets. The fine hydrocarbon droplets rise through the continuous solvent phase and coalesce into an interface layer 596 and are again dispersed through the tray 580 above. Solvent passes across each plate and flows downward from tray 580 above to the tray 580 below via downcomer 582. The principle interface 598 is maintained at the top of column 514. Aromatic-lean hydrocarbon liquid is removed from outlet 592 at the top of column 514 and aromatic-rich solvent liquid is discharged through outlet 594 at the bottom of column 514. Tray columns are efficient solvent transfer apparatus and have desirable liquid handling capacity and extraction efficiency, particularly for systems of low-interfacial tension.

Figure 8:
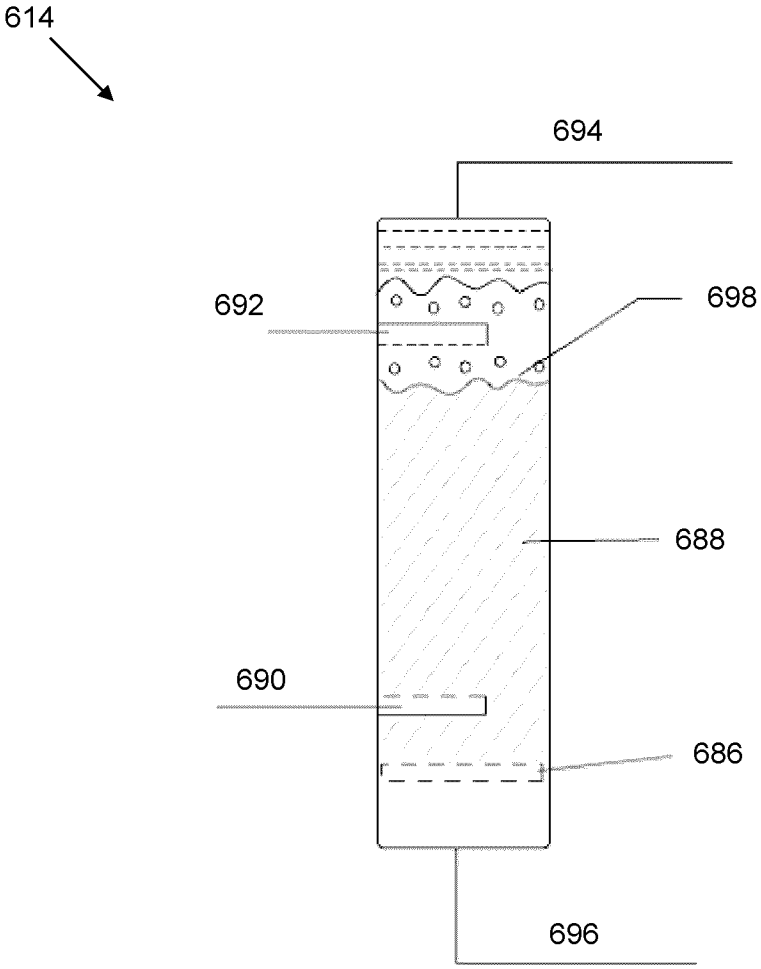

An additional type of unit operation suitable for extracting aromatics from the hydrocarbon feed is a packed bed column. FIG. 8 is a schematic illustration of a packed bed column 614 having a hydrocarbon inlet 690 and a solvent inlet 692. A packing region 688 is provided upon a support plate 686. Packing region 688 comprises suitable packing material including, but not limited to, Pall rings, Raschig rings, Kascade rings, Intalox saddles, Berl saddles, super Intalox saddles, super Berl saddles, Demister pads, mist eliminators, telerrettes, carbon graphite random packing, other types of saddles, and the like, including combinations of one or more of these packing materials. The packing material is selected so that it is fully wetted by the continuous solvent phase. The solvent introduced via inlet 692 at a level above the top of the packing region 688 flows downward and wets the packing material and fills a large portion of void space in the packing region 688. Remaining void space is filled with droplets of the hydrocarbon liquid which rise through the continuous solvent phase and coalesce to form the liquid-liquid interface 698 at the top of the packed bed column 614. Aromatic-lean hydrocarbon liquid is removed from outlet 694 at the top of column 614 and aromatic-rich solvent liquid is discharged through outlet 696 at the bottom of column 614. Packing material provides large interfacial areas for phase contacting, causing the droplets to coalesce and reform. The mass transfer rate in packed towers can be relatively high because the packing material lowers the recirculation of the continuous phase.

Figure 9:
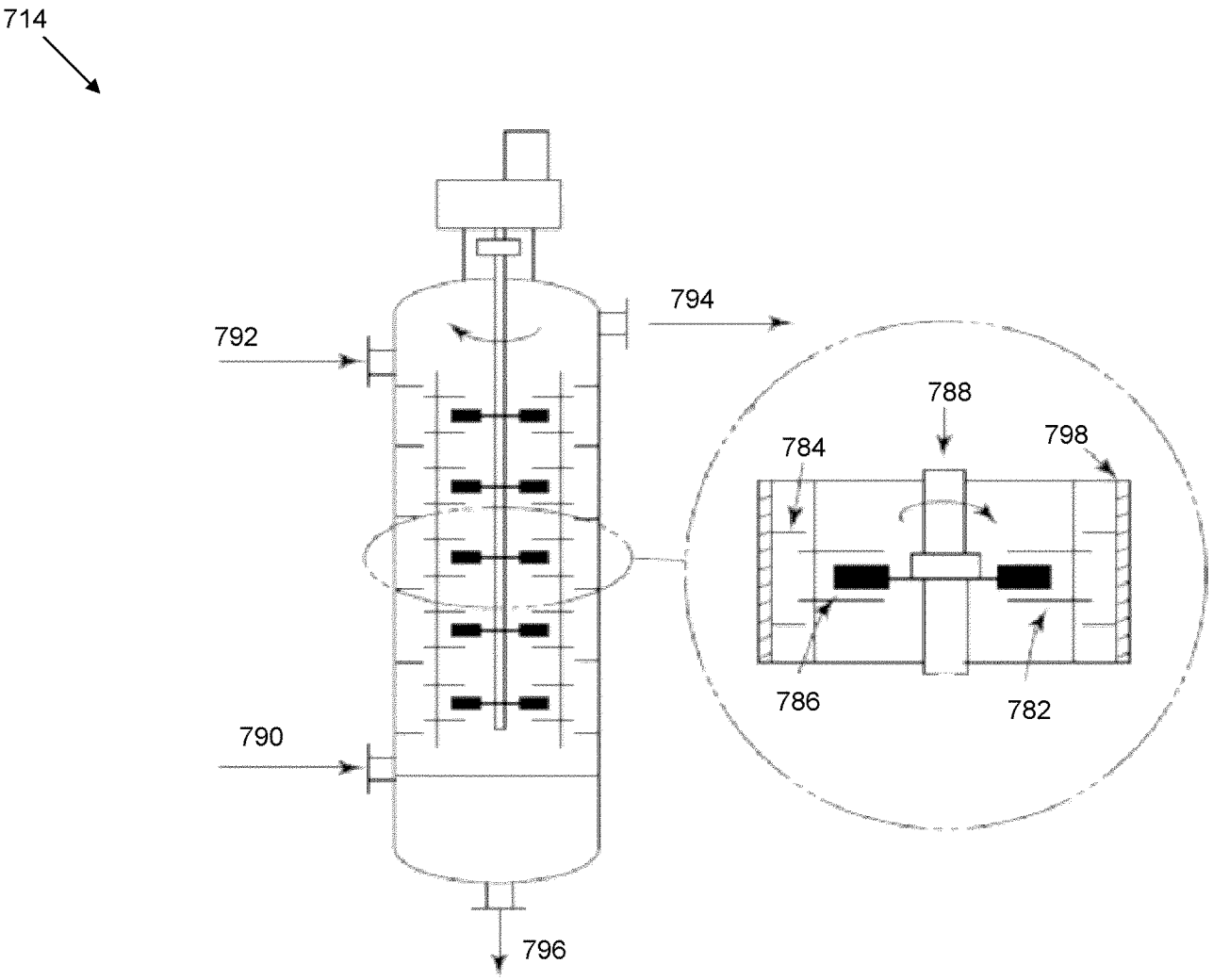

Further types of apparatus suitable for aromatic extraction in the system and method of the present invention include rotating disc contactors. FIG. 9 is a schematic illustration of a rotating disc contactor 714 known as a Scheibel® column commercially available from Koch Modular Process Systems, LLC of Paramus, N.J., USA. It will be appreciated by those of ordinary skill in the art that other types of rotating disc contactors can be implemented as an aromatic extraction unit included in the system and method of the present invention, including but not limited to Oldshue-Rushton columns, and Kuhni extractors. The rotating disc contactor is a mechanically agitated, counter-current extractor. Agitation is provided by a rotating disc mechanism, which typically runs at much higher speeds than a turbine type impeller as described with respect to FIG. 6.

Rotating disc contactor 714 includes a hydrocarbon inlet 790 toward the bottom of the column and a solvent inlet 792 proximate the top of the column, and is divided into number of compartments formed by a series of inner stator rings 782 and outer stator rings 784. Each compartment contains a centrally located, horizontal rotor disc 786 connected to a rotating shaft 788 that creates a high degree of turbulence inside the column. The diameter of the rotor disc 786 is slightly less than the opening in the inner stator rings 782. Typically, the disc diameter is 33-66% of the column diameter. The disc disperses the liquid and forces it outward toward the vessel wall 798 where the outer stator rings 784 create quiet zones where the two phases can separate. Aromatic-lean hydrocarbon liquid is removed from outlet 794 at the top of column 714 and aromatic-rich solvent liquid is discharged through outlet 796 at the bottom of column 714. Rotating disc contactors advantageously provide relatively high efficiency and capacity and have relatively low operating costs.

Figure 10:
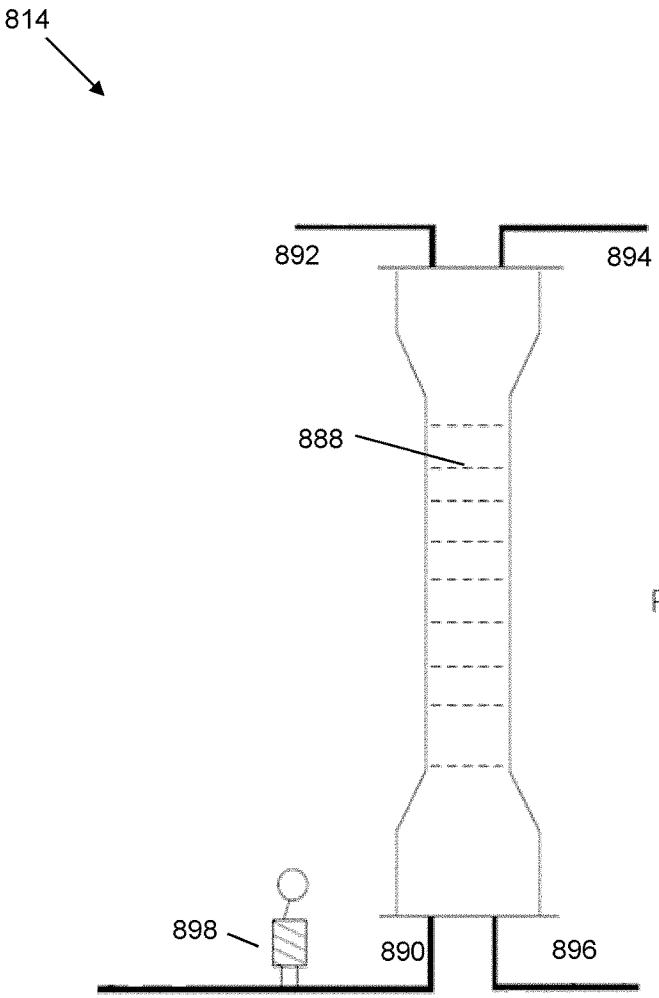

An additional type of apparatus suitable for aromatic extraction in the system and method of the present invention is a pulse column. FIG. 10 is a schematic illustration of a pulse column system 814, which includes a column with a plurality of packing or sieve plates 888, a light phase, i.e., solvent, inlet 890, a heavy phase, i.e., hydrocarbon feed, inlet 892, a light phase outlet 894 and a heavy phase outlet 896.

In general, pulse column system 814 is a vertical column with a large number of sieve plates 888 lacking down comers. The perforations in the sieve plates 888 typically are smaller than those of non-pulsating columns, e.g., about 1.5 mm to about 3.0 mm in diameter.

A pulse-producing device 898, such as a reciprocating pump, pulses the contents of the column at frequent intervals. The rapid reciprocating motion, of relatively small amplitude, is superimposed on the usual flow of the liquid phases. Bellows or diaphragms formed of coated steel (e.g., coated with polytetrafluoroethylene), or any other reciprocating, pulsating mechanism can be used. A pulse amplitude of 5-25 mm is generally recommended with a frequency of 100-260 cycles per minute. The pulsation causes the light liquid (solvent) to be dispersed into the heavy phase (oil) on the upward stroke and heavy liquid phase to jet into the light phase on the downward stroke. The column has no moving parts, low axial mixing, and high extraction efficiency.

Figure 11:
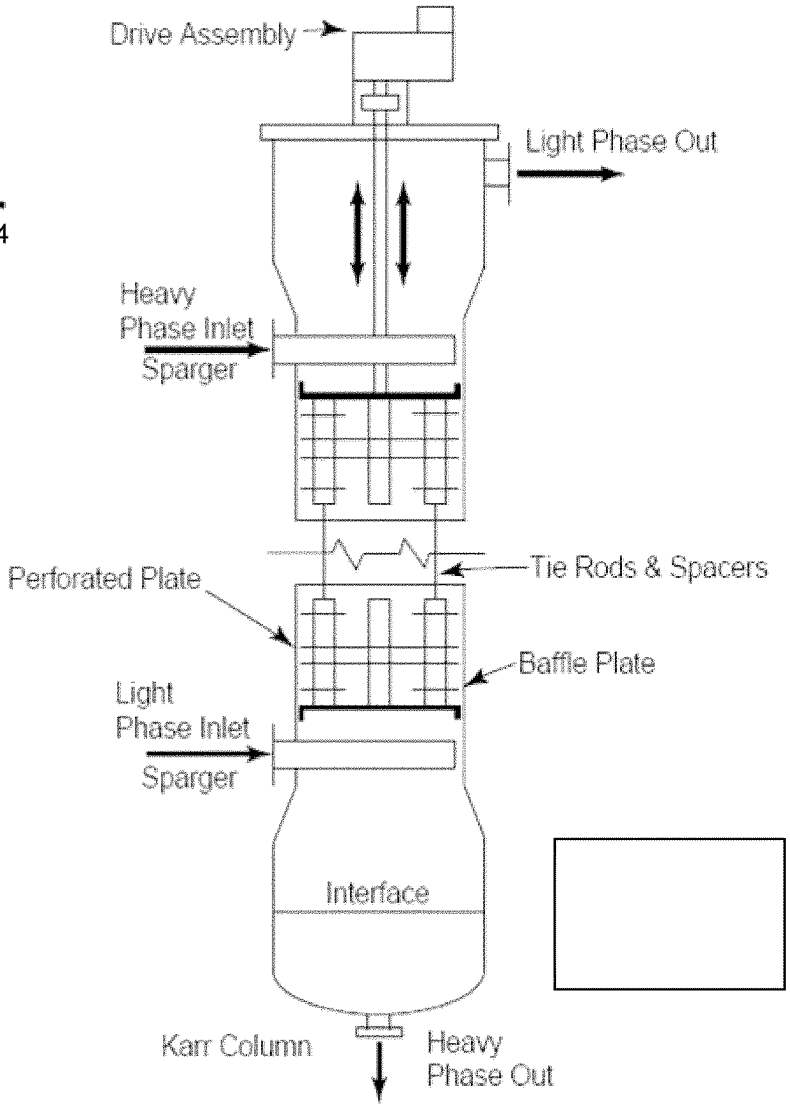

A pulse column typically requires less than a third the number of theoretical stages as compared to a non-pulsating column. A specific type of reciprocating mechanism is used in a Karr Column which is shown in FIG. 11.

The inclusion of an aromatic separation zone is included in an integrated system and process combining hydrocracking and FCC to allows allow a partition of the different classes of sulfur-containing compounds, thereby optimizing and economizing hydrocracking, hydrotreating and FCC unit operations. Only the aromatic-rich fraction of the original feedstream containing refractory sulfur-containing compounds is subjected to the hydrocracking zone operating under high pressure, thus the volumetric/mass flow through the high pressure hydrocracking zone is reduced. As a result, the requisite equipment capacity, and accordingly both the capital equipment cost and the operating costs, are minimized.

Advantageously, the present invention fully converts initial feedstock, in particular, heavy crude oil, into ultra low sulfur transportation fuels. By separating the initial feedstocks into aromatic-rich fraction and aromatic-lean fraction, the present invention produce naphtha and diesel that contains reduced levels of sulfur by hydrocracking aromatic-rich fraction under high pressure and gasoline that contains reduced levels of sulfur by cracking the aromatic-lean fraction in a FCC.

Further, in certain embodiments aromatic compounds without heteroatoms (e.g., benzene, toluene and their derivatives) are passed to the aromatic-rich fraction and are hydrogenated and hydrocracked in the hydrocracking zone to produce light distillates. The yield of these light distillates that meet the product specification derived from the aromatic compounds without heteroatoms is greater than the yield in conventional hydrocracking operations due to the focused and targeted hydrocracking zones.

EXAMPLES

A sample of vacuum gas oil (VGO) derived from Arab light crude oil was extracted in an extractor. Furfural was used as the extractive solvent. The extractor was operated at 60° C., atmospheric pressure, and at a solvent to feed ratio of 1.1:1. Two fractions were obtained: an aromatic-rich fraction and an aromatic-lean fraction. The aromatic-lean fraction yield was 52.7 W % and contained 0.43 W % of sulfur and 5 W % of aromatics. The aromatic-rich fraction yield was 47.3 W % and contained 95 W % of aromatics and 2.3 W % of sulfur. The properties of the VGO, aromatic-rich fraction and aromatic-lean fraction are given in Table 1.

TABLE 1

Properties of VGO and its Fractions

| Property | | VGO | VGO-Aromatic-Rich | VGO-Aromatic-Lean |
|---|---|---|---|---|
| Density at 15° C. | Kg/L | 0.922 | 1.020 | 0.835 |
| Carbon | W % | 85.27 | | |
| Hydrogen | W % | 12.05 | | |
| Sulfur | W % | 2.7 | 2.30 | 0.43 |
| Nitrogen | ppmw | 615 | 584 | 31 |
| MCR | W % | 0.13 | | |
| Aromatics | W % | 47.3 | 44.9 | 2.4 |
| N + P | W % | 52.7 | 2.6 | 50.1 |

The aromatic-rich fraction was hydrocracked in a fixed-bed hydrocracking unit containing Ni—Mo on silica alumina as hydrocracking catalyst at 150 Kg/cm$^2$ hydrogen partial pressure, 400° C., liquid hourly space velocity of 1.0 h$^{-1}$ and at hydrogen feed rate of 1,000 SLt/Lt. The Ni—Mo on alumina catalyst was used to desulfurize the aromatic-rich fraction, which includes a significant amount of the nitrogen content originally contained in the feedstock.

The aromatic-lean fraction was hydrotreated in a fixed-bed hydrotreating unit containing Ni—Mo on silica alumina as hydrotreating catalysts at 70 Kg/cm$^2$ hydrogen partial pressure, 370° C., liquid hourly space velocity of 1.0 h$^{-1}$ and at hydrogen feed rate of 1000 SLt/Lt. The product yields resulting from hydrocracking and hydrotreating reaction zones are given below.

TABLE 2

Product Yields

| | Hydrocracking of VGO-Aromatic-rich | Hydrotreating of VGO-Aromatic-lean |
|---|---|---|
| Stream # (FIG. 2) | 228 | 242 |
| Hydrogen | 1.13 | 0.71 |
| $H_2S$ | 1.14 | 0.24 |
| $NH_3$ | 0.03 | 0.00 |
| $C_1$-$C_4$ | 1.31 | 0.17 |
| Naphtha | 9.02 | 1.01 |
| Mid Distillates | 17.99 | 7.20 |
| Unconverted Bottoms | 18.92 | 44.80 |
| Total | 49.56 | 54.12 |

The unconverted bottoms from the hydrocracking and hydrotreating reaction zones were combined and send to the riser reactor of the FCC unit for further cracking. The FCC catalyst had a surface area of 131 m$^2$/g, a pore volume of 0.1878 cm$^3$/g, and a metal content of 504 ppmw (i.e., Ni or V). The reaction were conducted at a temperature of 518° C., a catalyst to oil ratio of 5:1, and a contact time of 2 seconds. The overall conversion, which is calculated from the equation: Conversion=(Feedstock−LCO−HCO)/Feedstock, was 70 W %. The FCC product yields are summarized in Table 3.

TABLE 3

FCC Product Yields*, Kg/h

| | Stream # | FCC |
|---|---|---|
| Feedstock | 232 | 63.7 |
| Gases | 233 | 10.6 |
| Gasoline | 234 | 32.1 |
| LCO | 236 | 9.4 |
| HCO | 238 | 9.8 |
| Total | | 61.9 |

*excludes coke yields

The method and system of the present invention have been described above and in the attached drawings; however, modifications will be apparent to those of ordinary skill in the art and the scope of protection for the invention is to be defined by the claims that follow.

I claim:

1. An integrated process for conversion of a feedstock to produce hydrocracked product and fluidized catalytically cracked product, the process comprising:

a. separating, in an aromatic separation zone, a hydrocarbon feed and an unconverted bottoms recycle stream, into an aromatic-lean fraction that contains labile organosulfur compounds and an aromatic-rich fraction that contains refractory aromatic organosulfur and/or organonitrogen compounds, wherein feed to the aromatic separation zone comprises the unconverted bottoms recycle stream and the hydrocarbon feed, wherein the hydrocarbon feed is selected from the group consisting of straight run gas oil, vacuum gas oil, deasphalted oil or demetalized oil obtained from a solvent deasphalting process, light coker or heavy coker gas oil obtained from a coker process, gas oil obtained from a visbreaking process, and a combination comprising two or more of the foregoing;

b. passing the aromatic-rich fraction to a hydrocracking reaction zone operating at a hydrogen partial pressure of at least about 60 Kg/cm$^2$ to convert at least a portion of refractory aromatic organosulfur and/or organonitrogen compounds and to produce hydrocracked product and an unconverted bottoms effluent;

c. recycling at least a portion of the unconverted bottoms effluent to the aromatic separation step as the unconverted bottoms recycle stream in step (a); and d. passing a fluid catalytic cracking feed to a fluid catalytic cracking reaction zone to produce cracked product, a light cycle oil stream and a heavy cycle oil stream, wherein the fluid catalytic cracking feed consists essentially of the aromatic-lean fraction or wherein the fluid catalytic cracking feed consists essentially of the aromatic-lean fraction in combination with a portion of the unconverted bottoms effluent.

2. The process of claim 1, wherein the fluid catalytic cracking feed consists essentially of the aromatic-lean fraction in combination with a portion of the unconverted bottoms effluent.

3. The process of claim 1, further comprising conveying a portion of the light cycle oil to the hydrocracking reaction zone.

4. The process of claim 1, further comprising conveying a portion of the heavy cycle oil to the hydrocracking reaction zone.

5. The process of claim 1, the hydrocarbon feed having an aromatic content and a non-aromatic content, wherein separating the hydrocarbon feed into an aromatic-lean fraction and an aromatic-rich fraction comprises: subjecting the hydrocarbon feed and an effective quantity of extraction solvent to an extraction zone to produce an extract containing a major proportion of the aromatic content of the hydrocarbon feed and a portion of the extraction solvent and a raffinate containing a major proportion of the non-aromatic content of the hydrocarbon feed and a portion of the extraction solvent; separating at least substantial portion of the extraction solvent from the raffinate and retaining the aromatic-lean fraction; and separating at least substantial portion of the extraction solvent from the extract and retaining the aromatic-rich fraction.

6. The process of claim 5, wherein the extraction solvent is selected from the group consisting of furfural, N-methyl-2-pyrrolidone, dimethylformamide, dimethylsulfoxide, phenol, nitrobenzene, sulfolanes, acetonitrile, and glycols.

7. The process of claim 5, wherein the extraction zone is a stage-type extractor.

8. The process of claim 5, wherein the extraction zone is a differential extractor.

9. The process of claim 1, wherein the aromatic-rich fraction includes benzothiophene, alkylated derivatives of benzothiophene, dibenzothiophene, alkyl derivatives of dibenzothiophene, benzonaphtenothiophene, and alkyl derivatives of benzonaphtenothiophene.

10. The process of claim 1, wherein the aromatic-rich fraction includes pyrrole, quinoline, acridines, carbazoles and their derivatives.

11. The process of claim 1, wherein the fluid catalytic cracking reaction zone includes a downflow reactor.

12. The process of claim 11, wherein the downflow reactor operates with catalyst and under conditions effective to promote formation of olefins and minimize olefin-consuming reactions including hydrogen-transfer reactions, said conditions including reaction temperature of from about 550° C. to about 650° C., reaction pressure of from about 1 Kg/cm$^2$ to about 20 Kg/cm$^2$, contact time (in the reactor) of from about 0.1 seconds to about 30 seconds; a catalyst to feed ratio of from about 10:1 to about 40:1; and use of a catalyst mixture containing base cracking catalyst and additive, the base cracking catalyst in the catalyst mixture in a range of 60 to 95 W % and the additive in the catalyst mixture in a range of 5 to 40 W %, wherein the base cracking catalyst is selected from the group consisting of natural zeolites, synthetic zeolites, Y-zeolite, kaolin, montmorilonite, halloysite, bentonite, porous alumina oxide, porous silica oxide, porous boria oxide, porous chromia oxide, porous magnesia oxide, porous zirconia oxide, porous titania oxide, and porous silica-alumina oxide, and wherein the additive comprises a shape-selective zeolite selected from the group consisting of ZSM-5 zeolite, zeolite omega, SAPO-5 zeolite, SAPO-11 zeolite, SAPO34 zeolite, and pentasil-type aluminosilicates.

13. The process of claim 1, wherein the fluid catalytic cracking reaction zone includes a riser reactor.

14. The process of claim 13, wherein the riser reactor operates with catalyst and under conditions effective to promote formation of olefins and minimize olefin-consuming reactions including hydrogen-transfer reactions, said conditions including reaction temperature of from about 480° C. to about 650° C.; reaction pressure of from about 1 Kg/cm$^2$ to about 20 Kg/cm$^2$; contact time (in the reactor) of from about 0.7 seconds to about 10 seconds, and a catalyst to feed ratio of from about 8:1 to about 20:1; and use of a catalyst mixture containing base cracking catalyst and additive, the base cracking catalyst in the catalyst mixture in a range of 60 to 95 W % and the additive in the catalyst mixture in a range of 5 to 40 W %, wherein the base cracking catalyst is selected from the group consisting of natural zeolites, synthetic zeolites, Y-zeolite, kaolin, montmorilonite, halloysite, bentonite, porous alumina oxide, porous silica oxide, porous boria oxide, porous chromia oxide, porous magnesia oxide, porous zirconia oxide, porous titania oxide, and porous silica-alumina oxide, and wherein the additive comprises a shape-selective zeolite selected from the group consisting of ZSM-5 zeolite, zeolite omega, SAPO-5 zeolite, SAPO-11 zeolite, SAPO34 zeolite, and pentasil-type aluminosilicates.

15. The process of claim 1, wherein step (d) comprises conveying a fluidized cracking catalyst mixture including a fluidized cracking base catalyst and a catalyst additive.

16. The process of claim 1, wherein feed to the aromatic separation zone consists essentially of the unconverted bottoms recycle from step (c) and the hydrocarbon feed.

17. The process of claim 1, wherein the hydrocarbon feed is straight run gas oil.

18. The process of claim 1, wherein the fluid catalytic cracking feed consists essentially of the aromatic-lean fraction.

19. An integrated process for conversion of a feedstock to produce hydrocracked product and fluidized catalytically cracked product, the process comprising:

a. separating, in an aromatic separation zone, a hydrocarbon feed and an unconverted bottoms recycle stream to an aromatic-lean fraction that contains labile organosulfur and/or organonitrogen compounds and an aromatic-rich fraction that contains sterically hindered refractory aromatic organosulfur compounds, wherein feed to the aromatic separation zone comprises the unconverted bottoms recycle stream and the hydrocarbon feed, wherein the hydrocarbon feed is selected from the group consisting of straight run gas oil, vacuum gas oil, deasphalted oil or demetalized oil obtained from a solvent deasphalting process, light coker or heavy coker gas oil obtained from a coker process gas oil obtained from a visbreaking process and a combination comprising two or more of the foregoing;

b. passing the aromatic-rich fraction to a hydrocracking reaction zone operating at a hydrogen partial pressure of at least about 60 $Kg/cm^2$ to convert at least a portion of refractory aromatic organosulfur and/or organonitrogen compounds and to produce a hydrocracked product stream and an unconverted bottoms effluent;

c. recycling at least a portion of the unconverted bottoms effluent to the aromatic separation step as the unconverted bottoms recycle stream in step (a);

d. passing the aromatic-lean fraction to a hydrotreating reaction zone operating at a pressure in the range of about 20.4 $Kg/cm^2$ to about 61.2 $Kg/cm^2$ to desulfurize at least a portion of aromatic-lean fraction and to produce a hydrotreated stream; and e. passing a fluid catalytic cracking feed to a fluid catalytic cracking reaction zone to produce cracked product, a light cycle oil stream and a heavy cycle oil stream, wherein the fluid catalytic cracking feed consists essentially of the hydrotreated stream or wherein the fluid catalytic cracking feed consists essentially of the hydrotreated stream in combination with a portion of the unconverted bottoms effluent.

20. The process of claim 19, wherein the fluid catalytic cracking feed consists essentially of the hydrotreated stream in combination with a portion of the unconverted bottoms effluent.

21. The process of claim 19, further comprising conveying a portion of the light cycle oil to the hydrocracking reaction zone.

22. The process of claim 19, further comprising conveying a portion of the heavy cycle oil to the hydrocracking reaction zone.

23. The process of claim 19, the hydrocarbon feed having an aromatic content and a non-aromatic content, wherein separating the hydrocarbon feed into an aromatic-lean fraction and an aromatic-rich fraction comprises: subjecting the hydrocarbon feed and an effective quantity of extraction solvent to an extraction zone to produce an extract containing a major proportion of the aromatic content of the hydrocarbon feed and a portion of the extraction solvent and a raffinate containing a major proportion of the non-aromatic content of the hydrocarbon feed and a portion of the extraction solvent; separating at least substantial portion of the extraction solvent from the raffinate and retaining the aromatic-lean fraction; and separating at least substantial portion of the extraction solvent from the extract and retaining the aromatic-rich fraction.

24. The process of claim 23, wherein the extraction solvent is selected from the group consisting of furfural, N-methyl-2-pyrrolidone, dimethylformamide, dimethylsulfoxide, phenol, nitrobenzene, sulfolanes, acetonitrile, and glycols.

25. The process of claim 23, wherein the extraction zone is a stage-type extractor.

26. The process of claim 23, wherein the extraction zone is a differential extractor.

27. The process of claim 19, wherein the aromatic-rich fraction includes benzothiophene, alkylated derivatives of benzothiophene, dibenzothiophene, alkyl derivatives of dibenzothiophene, benzonaphtenothiophene, and alkyl derivatives of benzonaphtenothiophene.

28. The process of claim 19, wherein the aromatic-rich fraction includes pyrrole, quinoline, acridines, carbazoles and their derivatives.

29. The process of claim 19, wherein the fluid catalytic cracking reaction zone includes a downflow reactor.

30. The process of claim 29, wherein the downflow reactor operates with catalyst and under conditions effective to promote formation of olefins and minimize olefin-consuming reactions including hydrogen-transfer reactions, said conditions including reaction temperature of from about 550° C. to about 650° C., reaction pressure of from about 1 $Kg/cm^2$ to about 20 $Kg/cm^2$, contact time (in the reactor) of from about 0.1 seconds to about 30 seconds; a catalyst to feed ratio of from about 10:1 to about 40:1; and use of a catalyst mixture containing base cracking catalyst and additive, the base cracking catalyst in the catalyst mixture in a range of 60 to 95 W % and the additive in the catalyst mixture in a range of 5 to 40 W %, wherein the base cracking catalyst is selected from the group consisting of natural zeolites, synthetic zeolites, Y-zeolite, kaolin, montmorilonite, halloysite, bentonite, porous alumina oxide, porous silica oxide, porous boria oxide, porous chromia oxide, porous magnesia oxide, porous zirconia oxide, porous titania oxide, and porous silica-alumina oxide, and wherein the additive comprises a shape-selective zeolite selected from the group consisting of ZSM-5 zeolite, zeolite omega, SAPO-5 zeolite, SAPO-11 zeolite, SAPO34 zeolite, and pentasil-type aluminosilicates.

31. The process of claim 19, wherein the fluid catalytic cracking reaction zone includes a riser reactor.

32. The process of claim 31, wherein the riser reactor operates with catalyst and under conditions effective to promote formation of olefins and minimize olefin-consuming reactions including hydrogen-transfer reactions, said conditions including reaction temperature of from about 480° C. to about 650° C.; reaction pressure of from about 1 $Kg/cm^2$ to about 20 $Kg/cm^2$; contact time (in the reactor) of from about 0.7 seconds to about 10 seconds, and a catalyst to feed ratio of from about 8:1 to about 20:1; and use of a catalyst mixture containing base cracking catalyst and additive, the base cracking catalyst in the catalyst mixture in a range of 60 to 95 W % and the additive in the catalyst mixture in a range of 5 to 40 W %, wherein the base cracking catalyst is selected from the group consisting of natural zeolites, synthetic zeolites, Y-zeolite, kaolin, montmorilonite, halloysite, bentonite, porous alumina oxide, porous silica oxide, porous boria oxide, porous chromia oxide, porous magnesia oxide, porous zirconia oxide, porous titania oxide, and porous silica-alumina oxide, and wherein the additive comprises a shape-selective zeolite selected from the group consisting of ZSM-5 zeolite, zeolite omega, SAPO-5 zeolite, SAPO-11 zeolite, SAPO34 zeolite, and pentasil-type aluminosilicates.

33. The process of claim 19, wherein step (e) comprises conveying a fluidized cracking catalyst mixture including a fluidized cracking base catalyst and a catalyst additive.

34. The process of claim 19, wherein a feed to the aromatic separation zone consists essentially of the unconverted bottoms recycle from step (c) and the hydrocarbon feed.

35. The process of claim 19, wherein the hydrocarbon feed is straight run gas oil.

36. The process of claim 19, wherein the fluid catalytic cracking feed consists essentially of the hydrotreated stream.

* * * * *